US006418672B1

(12) United States Patent
Hampel

(10) Patent No.: US 6,418,672 B1
(45) Date of Patent: Jul. 16, 2002

(54) RESIN BUILDING

(76) Inventor: Lance T. Hampel, 5678 W. Big Portage Lake Rd., Land O' Lakes, WI (US) 54540

( * ) Notice: Subject to any disclaimer, the term of this patent is extended or adjusted under 35 U.S.C. 154(b) by 0 days.

(21) Appl. No.: 09/504,513

(22) Filed: Feb. 15, 2000

Related U.S. Application Data

(60) Provisional application No. 60/120,828, filed on Feb. 19, 1999.

(51) Int. Cl.[7] ..... E04H 1/00; E04H 14/00; E04H 3/00; E04H 5/00; E04H 6/00

(52) U.S. Cl. ..... 52/79.1; 52/309.1; 52/79.5; 52/36.1; 4/460; 4/612; 446/108

(58) Field of Search ..... 52/79.1, 79.5, 52/36.1, 246, 36.2, 77.9, 293.1, 293.3, 285.2; 4/460, 614, 613, 612, 449, 459, 611, 527; 446/108, 111, 113, 476; 403/408.1

(56) References Cited

U.S. PATENT DOCUMENTS

| | | | | |
|---|---|---|---|---|
| 4,380,836 A | | 4/1983 | Braxton | 4/460 |
| 4,446,585 A | | 5/1984 | Harding et al. | 4/460 |
| D275,520 S | | 9/1984 | Harding et al. | D25/16 |
| 4,493,118 A | | 1/1985 | Braxton | 4/460 |
| 4,574,025 A | * | 3/1986 | Juaire et al. | 52/206 |

OTHER PUBLICATIONS

Applicant's Exhibit B, L, H.*

Applicant's Exhibit A, "TUFF–JON" four–page color brochure of the TSF Company, Inc., Evansville, IN, undated, admitted prior art.

Applicant's Exhibit B, "The Shed" two–page color brochure of Hampel Corp., Germantown, WI, undated, admitted prior art.

Applicant's Exhibit C, two–page color brochure of Olympic Fiberglass Industries, Inc., Rochester, IN, undated, admitted prior art.

Applicant's Exhibit E, "Get the Works at PolyJohn", two–page color brochure of PolyJohn, Whiting, IN, 1999, admitted prior art.

Applicant's Exhibit F, "Nu–Concepts '99 VIP Portable Restroom" four–page color brochure of Nu–Concepts, Ontario, Cananda, undated, admitted prior art.

Applicant's Exhibit G, "No. 1 in Europe", two–page color brochure of Thal–Mondo, Staffordshire, England, admitted prior art.

Applicant's Exhibit H, "High Tech 1", ten–page color brochure of Synergy World, Inc., St. Louis, MO, undated, admitted prior art.

Applicant's Exhibit I, "Eagle Star", two–page color brochure of American Poly Corporation, Zeeland, MI, undated, admitted prior art.

Applicant's Exhibit J, "Maxim 2000", four–page color brochure of Satellite Industries, Inc., Minneapolis, MN, undated, admitted prior art.

Applicant's Exhibit K, "Resi Dome—The Unique No–Maintenance Garden Room", one–page black–and–white advertisement, undated.

Applicant's Exhibit L, "Global, The World of Toilet Hire—Die Mobile Toilette", six–page color brochure of Global Fliegenschmidt GmbH in Anhalt, Deutschland and Mobile Toilet Manufacturers in Walsall West Mids.

* cited by examiner

*Primary Examiner*—Carl D. Friedman
*Assistant Examiner*—Chi Q. Nguyen
(74) *Attorney, Agent, or Firm*—Quarles & Brady LLP

(57) ABSTRACT

Disclosed herein is a multi-use building structure and method of assembling same. The building has its major components preferably made of twin sheets of plastic resin, each sheet formed to define different inner and outer surfaces. The building includes unique fasteners and connections facilitating quick and easy assembly for use and disassembly for shipping. The building may be used for different purposes with simple modifications, including a portable toilet, ticket booth, shelter, and storage shed.

21 Claims, 26 Drawing Sheets

FIG. 5A
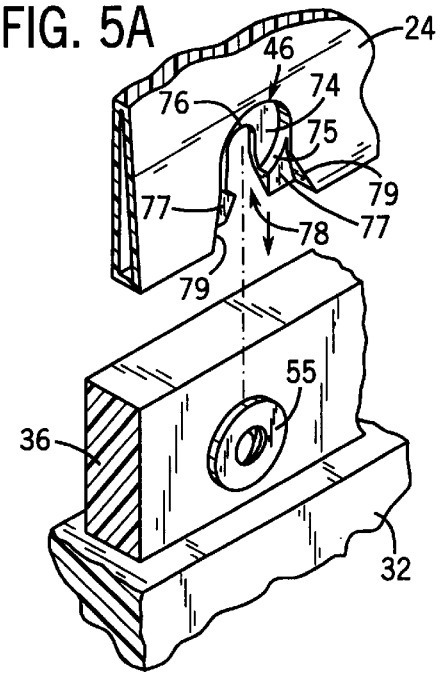
FIG. 5C
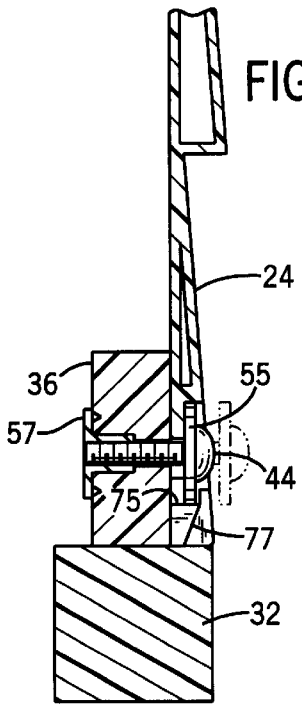
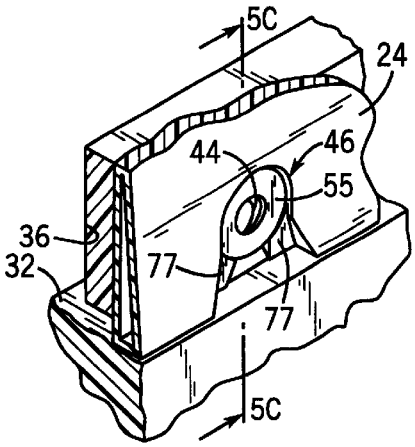
FIG. 5B
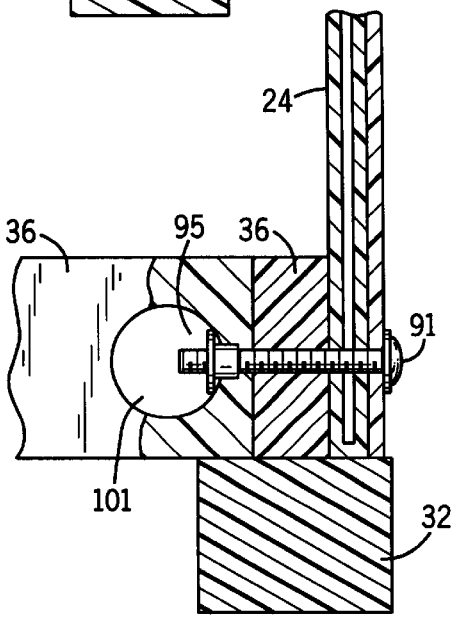
FIG. 5E

FIG. 5D
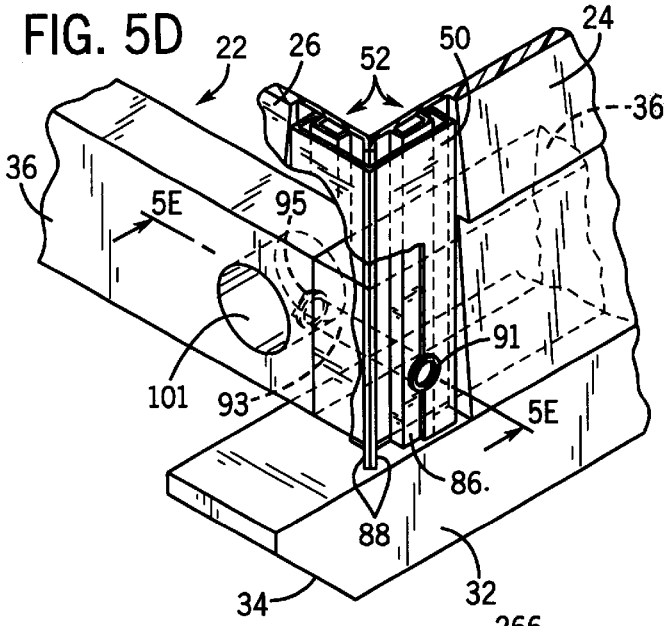
FIG. 11G
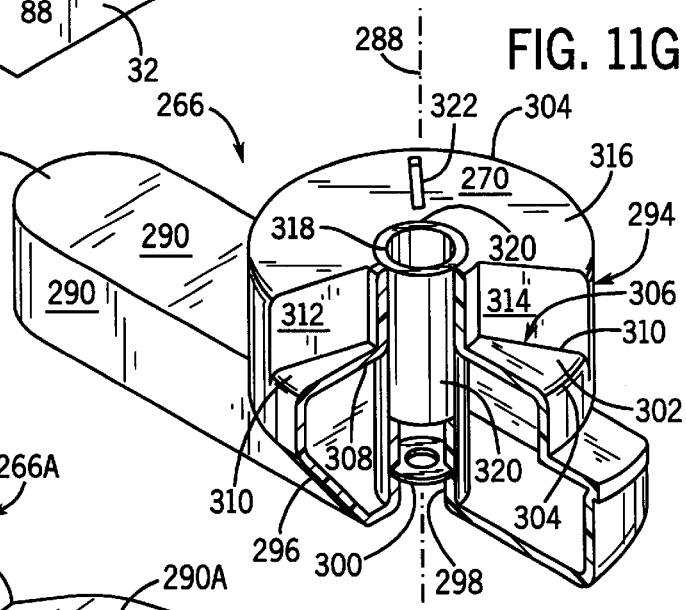
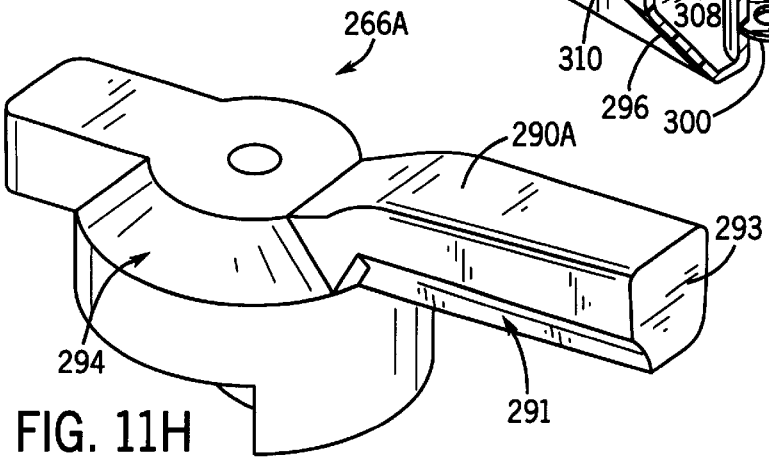
FIG. 11H

FIG. 6A
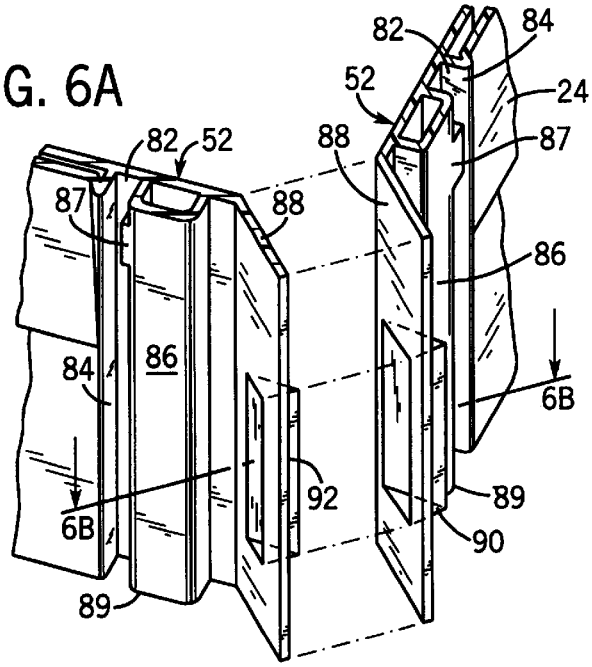
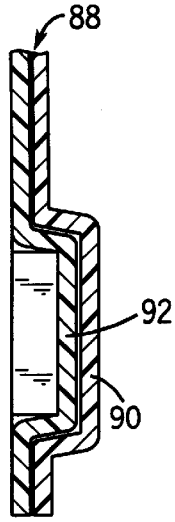
FIG. 6E
FIG. 6B
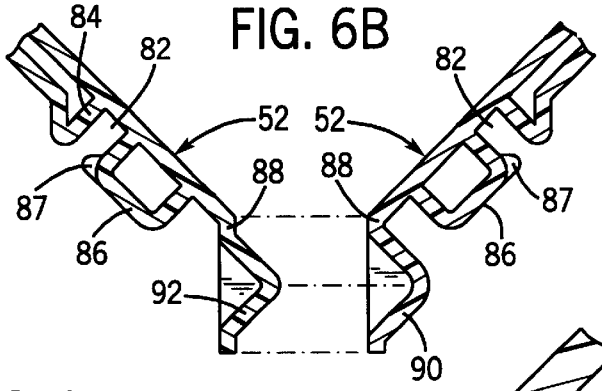
FIG. 6C
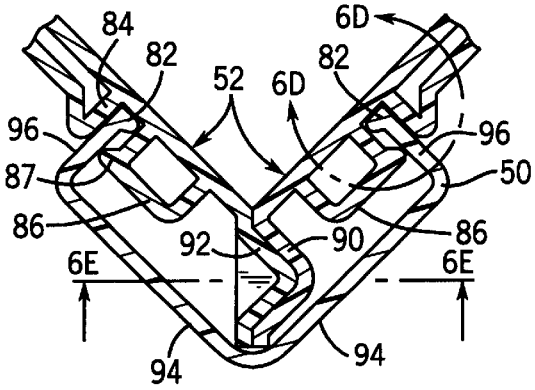
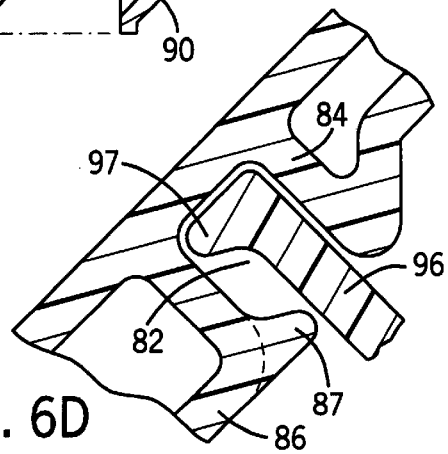
FIG. 6D FIG. 7A
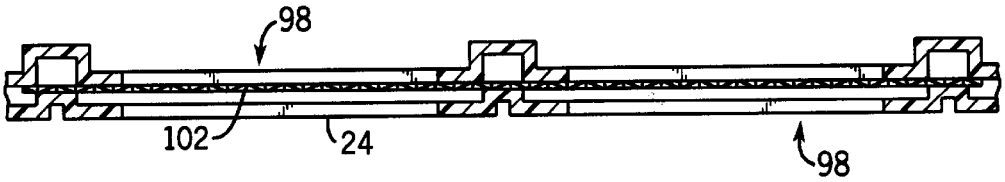
FIG. 7C
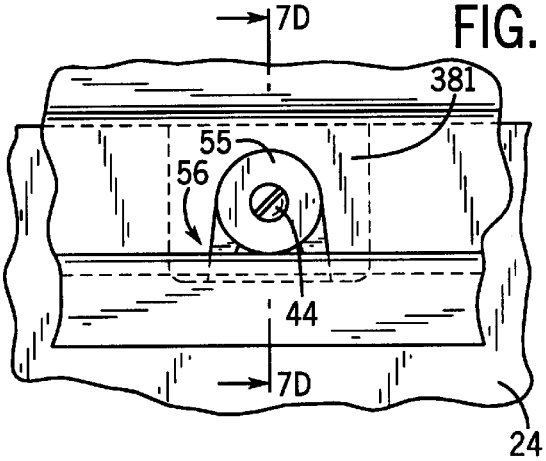
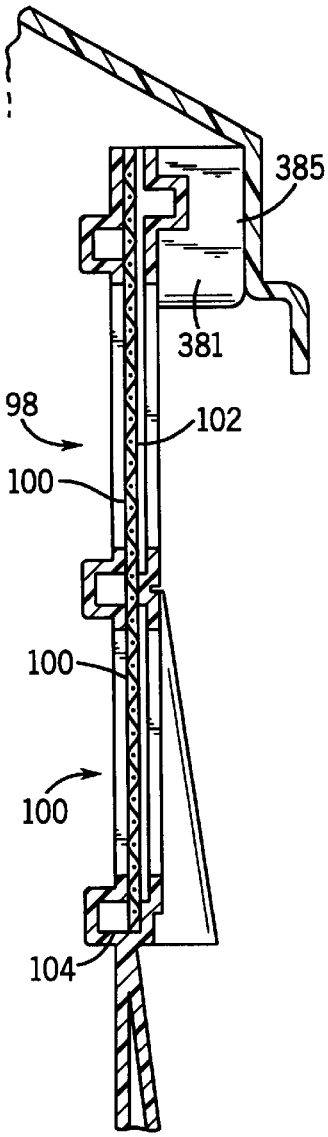
FIG. 7B
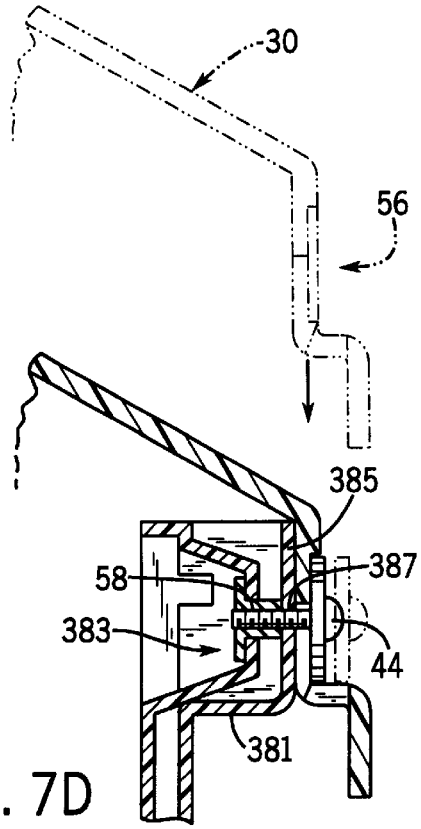
FIG. 7D 24
60
106
118
110
62
116
61
114
59
108
120
42

8C
110
118
24
60
106
120
42
8C
62
114
116
61
59
108

110
116
24
114
120
42

FIG. 9A
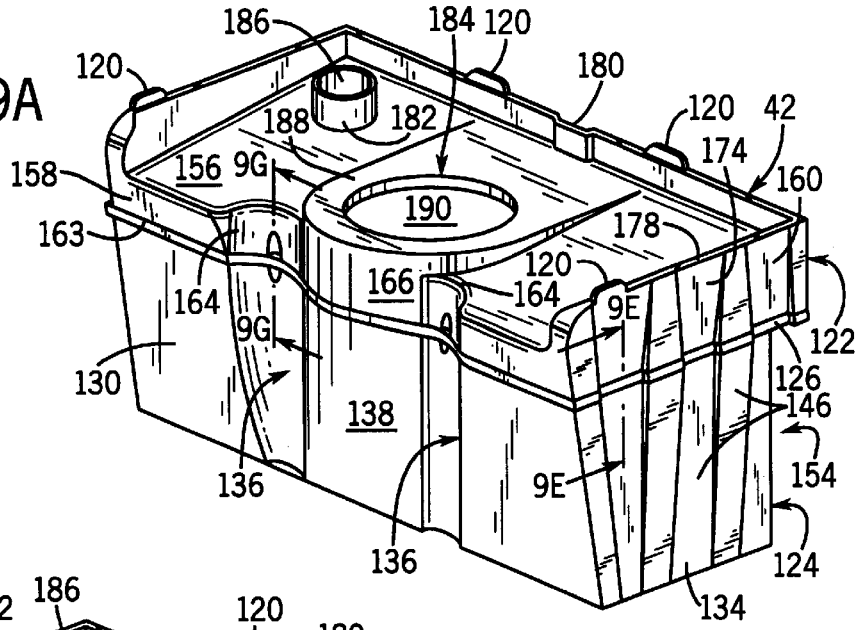
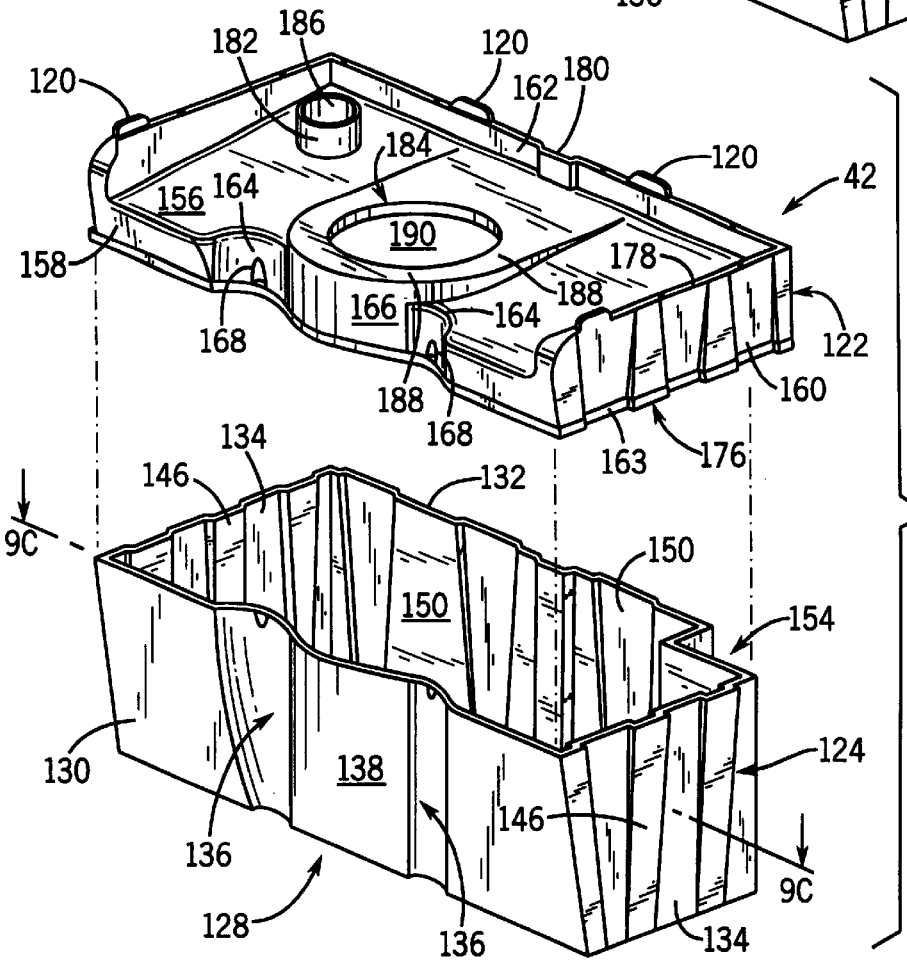
FIG. 9B

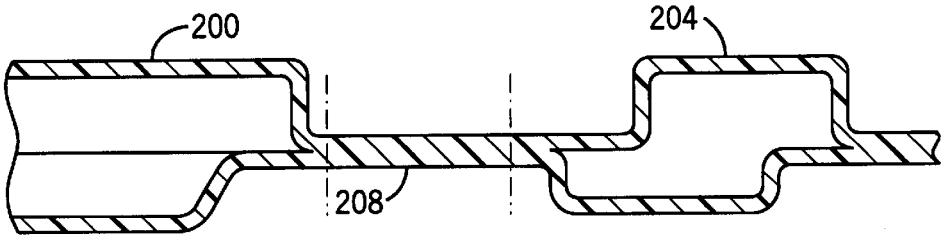
FIG. 10C
FIG. 10D
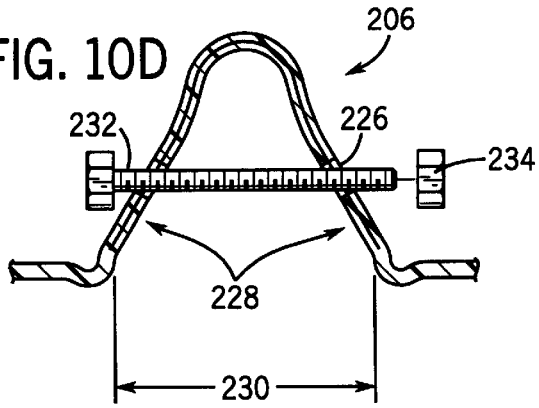
FIG. 10E
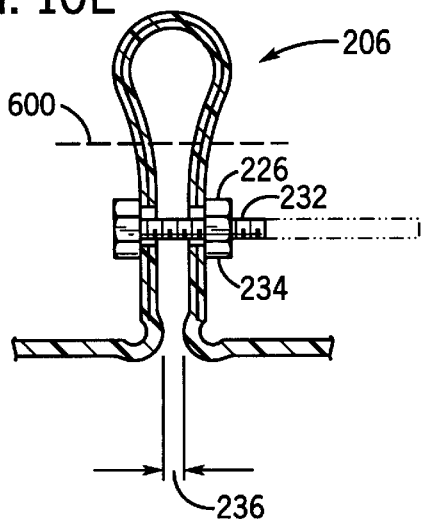
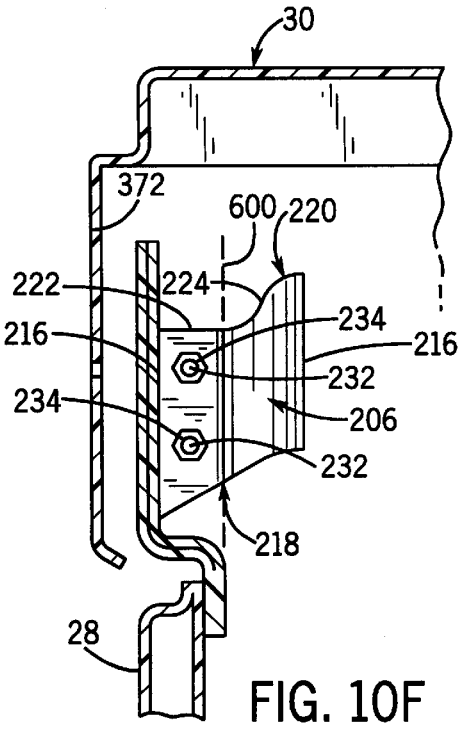
FIG. 10F 398
398
30
50
50

415
26
26
50
98
28
50
28
50
24
415
32
50
24
98
34
32

24
106
112
24
40
34
42
32
32
34
22
34
22

RESIN BUILDING

CROSS-REFERENCE TO RELATED APPLICATIONS

This application claims the benefit of provisional application Serial No. 60/120,828, filed Feb. 19, 1999.

STATEMENT REGARDING FEDERALLY SPONSORED RESEARCH OR DEVELOPMENT (Not applicable).

BACKGROUND OF THE INVENTION

1. Field of the Invention

This invention relates generally to a plastic resin building, for example, an outhouse or bus stop, that is easily assembled, durable, efficiently moldable and transportable in bulk, washable and portable when assembled.

2. Discussion of the Prior Art

Outdoor shelter structures, such as portable outhouses, are commonly rented and used for special events, such as parties, festivals or concerts, as well as at job sites or other locations where people are gathered temporarily. Prior art portable outhouses are, for the most part, unsightly from the outside and unpleasant on the inside.

Typically, portable outhouses are transported fully assembled and in large numbers to their end use sites. They are generally rough handled. For example, it is not uncommon for them to be dropped off of a flatbed truck. Therefore, they must be very durable. In addition, the large size and low weight of an assembled portable outhouse, relative to the payload capacity of a truck, makes shipping them assembled costly. As a result, some structures have been manufactured to be shipped in separate components and assembled on site by either the supplier (i.e., the rental company) or the end customer. The assembly process is typically difficult and time consuming, since there are often numerous components that cannot be easily aligned. The assembly time and cost is further exacerbated when a large number of units are involved.

Additionally, the door latches on existing structures are typically small metal hooks, catches or sliding bolts that are difficult to secure in place, prone to breaking or misoperation and are difficult to operate from outside the structure. The ability to operate the latch from outside the structure is particularly important for opening the door in the event a small child or incapacitated person was locked inside. It is also useful to be able to lock the doors from the outside when transporting fully assembled units to keep the doors from opening and slamming shut.

BRIEF SUMMARY OF THE INVENTION

The present invention provides a multi-use building which has its major components moldable from plastic resin. Aspects of the invention make the components compactly shippable and easily assembled. Once assembled, the building is aesthetically pleasing, low maintenance and durable.

The building may be used for different purposes with simple modifications, such as an outhouse, bus stop shelter, ticket booth, sentry hut and storage shed. If used as an outhouse, the building walls are built around a septic tank, which also aids in the assembly process by holding up three sides of the building before the sides are permanently secured. Once they are permanently secured, the walls secure the tank, with no additional attachment of the tank needed. The sides are easily attached to the base and roof using specially molded-in receivers, which permit receipt and seating of the fasteners without complete removal of the fasteners, which facilitates one-person assembly of the building. Side edges of each wall are attached to the side edges of the adjacent walls at the corners of the building using a plastic extrusion, and the edges inter-fit with one another to reduce racking of the building. The tank itself also features one-piece molding, with subsequent cutting into two pieces, each of which is nestable with other pieces of the same kind for compact shipping and easy assembly.

Using a double walled molding method for the walls of the building, spaces are created between the inner and outer layers of the walls into which a sheet can be inserted. The sheet may be a screen to provide for ventilation or a transparent panel to provide a window. The portions of the two layers of the wall are cut out in an area smaller than the inserted sheet and the edges of the inserted sheet between the two layers of the wall are trapped by welds between the two layers, or by fasteners which may be threaded through the two layers. The area which may be cut out to make a window if desired, can be made flat, so that if it is not cut out, signage, such as the sign of the outhouse rental company, can be placed over it for display.

In another aspect, the outer layer is molded to have a design, for example siding, bricks, stones or other like design. The ridges of the design reinforce the wall because the shape creates solid sections which extend horizontally and also because where the outer layer is recessed from the exterior of the building, the outer layer is fused to the inner layer. The inner layer is preferably made generally flat and smooth, particularly if the building is used as an outhouse, for easy cleaning.

In another aspect, the door and door panel include several unique features. One is that the door and door frame are molded with a living hinge in the portion which becomes the door frame. Cutting the door frame into two pieces after cutting the door from the door panel is not necessary in this design, as the living hinge flexes to permit pulling the two sides of the door frame together to create side-to-side overlap with the door. Maintaining this connection between the two sides of the door frame helps keep the two sides aligned during assembly and reinforces the building. The living hinge also creates a coat hook inside the building. In this connection, a keystone can be molded as part of the roof to cover the seam between the two sides of the door frame, at the outer end of the living hinge.

In another aspect concerning the door, the door has a plastic molded latch which is large, washable, easy to assemble and durable. The latch and door designs cooperate to provide their own stops, and a stick-on indicator can be applied to the latch so that it indicates to a person standing outside of the building whether the latch is latched or unlatched. A detent may also be provided between the door and the latch to secure the latch in an unlatched position. Should the latch accidentally close however, the latch is made with a slot which is accessible from the outside so that the latch can be unlatch from the outside.

The door is also molded with signage holders. If used as an outhouse, it is useful to identify which gender the outhouse is intended for, or whether both genders may use it. Thus, a gender card holder is molded into the outer surface of the door. For advertising, a business card holder is molded into the outer surface of the door, for example, so that the outhouse rental company can put its card or cards in the holder.

The roof also includes features to make the building well lit by daylight and leak resistant in a rain storm. The roof has a skylight attached to it, and rain gutters are molded into the roof at the upper corners of the skylight and down along the sides of the skylight to channel rain water which may leak past the skylights away from the opening in the roof beneath the skylights. Thereby, leakage through the roof is reduced, while providing good daylight lighting.

The foregoing and other objects and advantages of the invention will appear from the following description. In this description reference is made to the accompanying drawings which form a part hereof and in which there is shown by way of illustration a preferred embodiment of the invention. Such embodiment does not necessarily represent the full scope of the invention.

BRIEF DESCRIPTION OF THE DRAWINGS

FIG. 5A is an enlarged fragmentary exploded perspective view of a side panel and the base, showing the assembly of a side panel to the base;

FIG. 5A is an enlarged fragmentary perspective view of a side panel and base, showing one connection of the side panel to the base;

FIG. 5C is a cross-sectional view taken along line 5C—5C of FIG. 5B showing the connection of the side panel to the base;

FIG. 5D is a cut-away perspective view showing a side panel joined to the base;

FIG. 5E is a cross-sectional view taken along line 5E—5E of FIG. 5D;

FIG. 6A is a fragmentary exploded perspective view of the edges of the side panels;

FIG. 6B is a cross-sectional view taken along line 6B—6B of FIG. 6A;

FIG. 6C is a cross-sectional view taken along line 6B—6B of FIG. 6A, showing the edges joined with a corner piece.

FIG. 6D is a detail view of the area within arc 6D—6D of FIG. 6C;

FIG. 6E is a cross-sectional view taken along line 6E—6E of FIG. 6C, showing an interlock on the side panel flanges (but not the corner piece);

FIG. 7A is a fragmentary cross-sectional view taken along line 7A—7A of FIG. 3, showing a segment of a side panel with vents and a mesh screen sandwiched by layers of the panel;

FIG. 7B is a fragmentary cross-sectional view taken along line 7B—7B of FIG. 3 of the roof and a side panel, showing the vents and mesh screen;

FIG. 7C is a detail view of one roof-side panel connection from the outside;

FIG. 7D is a cross-sectional view taken along line 7D—7D of FIG. 7C, showing the roof-side panel connection;

FIG. 9A is a perspective view of the elimination tank of the outhouse embodiment of the outdoor structure of FIG. 1;

FIG. 9B is an exploded perspective view of the tank of FIG. 9A;

FIG. 10C is a cross-sectional view taken along line 10C—10C of FIG. 10A before the door is cut out;

FIG. 10D is a cross-sectional view taken along line 10D—10D of the one-piece front panel of FIG. 10A before the door is cut out, showing the flexible living hinge portion of the door frame panel as molded;

FIG. 10E is a cut-away cross-sectional view taken along line 10E—10E of the living hinge portion of the door frame panel of FIG. 10B secured in the folded position as needed to properly frame the door;

FIG. 10F is a cross-sectional view taken along line 10F—10F of FIG. 2;

FIG. 11G is a perspective view of the door latch;

FIG. 11H is a perspective view of an alternate door latch having a recessed grip handle;

DETAILED DESCRIPTION OF THE PREFERRED EMBODIMENTS

Figure 1:
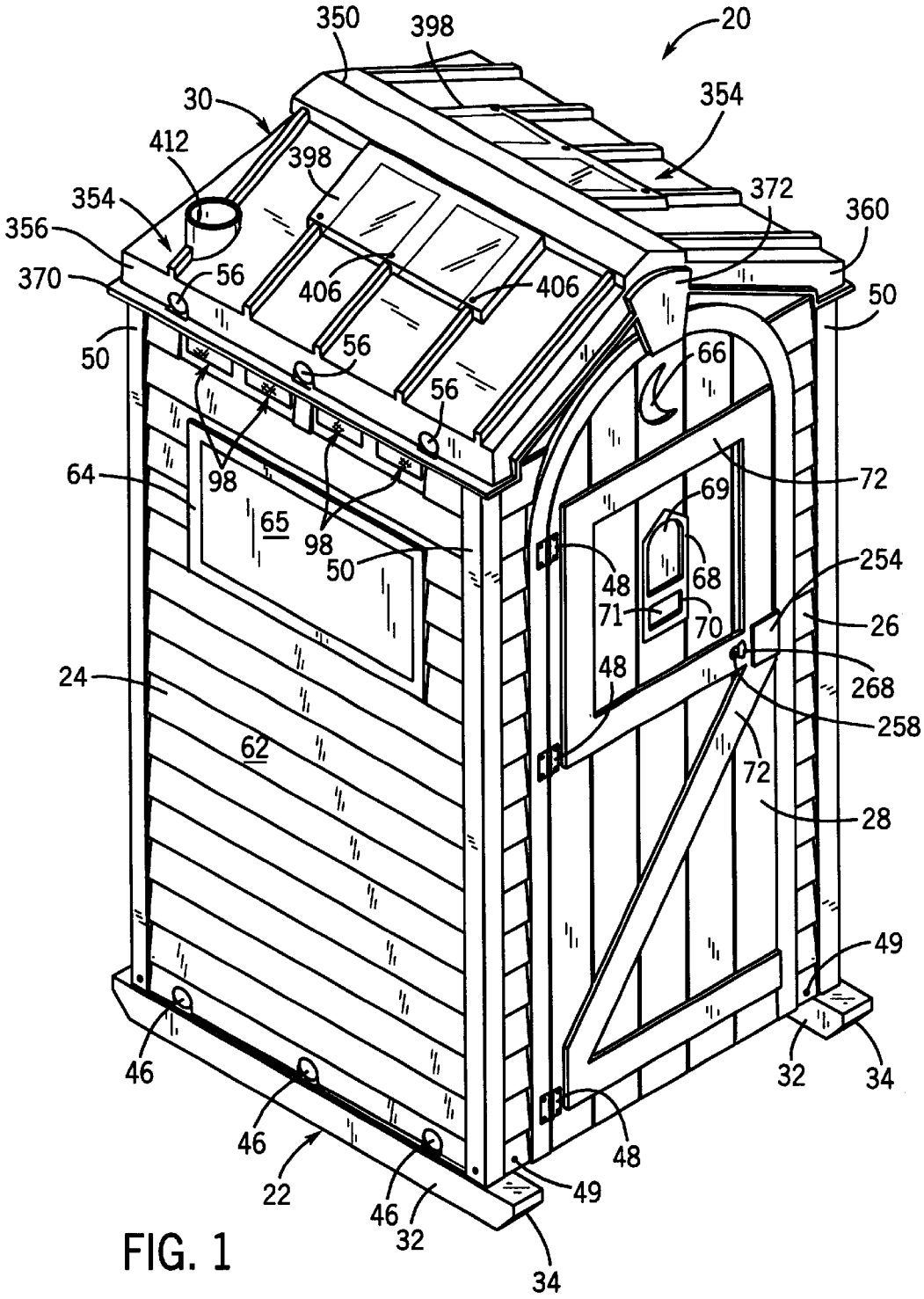
FIG. 1 is a perspective view of a building of the present invention.
Figure 14A:
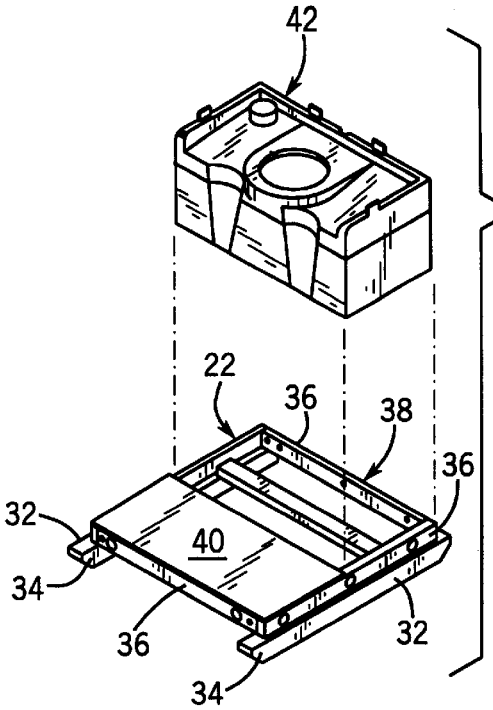
FIG. 14A is an exploded assembly view of the base and tank of the building of FIG. 1.

The outdoor structure, or building, of the present invention is indicated generally by reference number 20 of FIG. 1. In general, the outdoor structure 20 comprises a base 22, side panels 24, a door frame panel 26, a door 28 and a roof 30. As best shown in FIG. 14A, the base 20 is made of a plastic wood material (solid recycled plastic) and has two transverse feet 32 that are slightly longer than the structure 20 and approximately 4" wide. The feet 32 have front and rear tapered ends 34, oriented to taper downward toward the structure 20 so as to facilitate sliding the structure 20. The feet 32 support transverse and lateral members 36 fastened together to form an essentially rectangular framework 38. The framework 38 in turn supports a floor board 40, roughly ½" thick and covering approximately the front half of the framework 38. The rear half of the framework 38 supports the elimination or septic tank 42, shown in FIG. 14B and discussed in detail below.

In general, one side panel 24 is attached at its bottom to each of the rear lateral and two transverse members 36, which form the perimeter of the framework 38. Bolts 44 fasten the panels 24 to the framework 38 at slots 46 located along the lower edge of the panels 24. The door 28 is mounted to the door frame panel 26 by hinges 48, and the door frame panel 26 is attached to the front lateral member 36 by threaded fasteners 49. Longitudinal corners 50 join adjacent longitudinal edges 52 of the panels 24 and 26. Finally, the roof 30 is joined to the panels 24 by bolts 44 and washers 55 through slots 56 in the roof 30 and bores 58 (see FIG. 7D) in the upper edge of the panels 24 and fastened to nuts 57.

Figure 2:
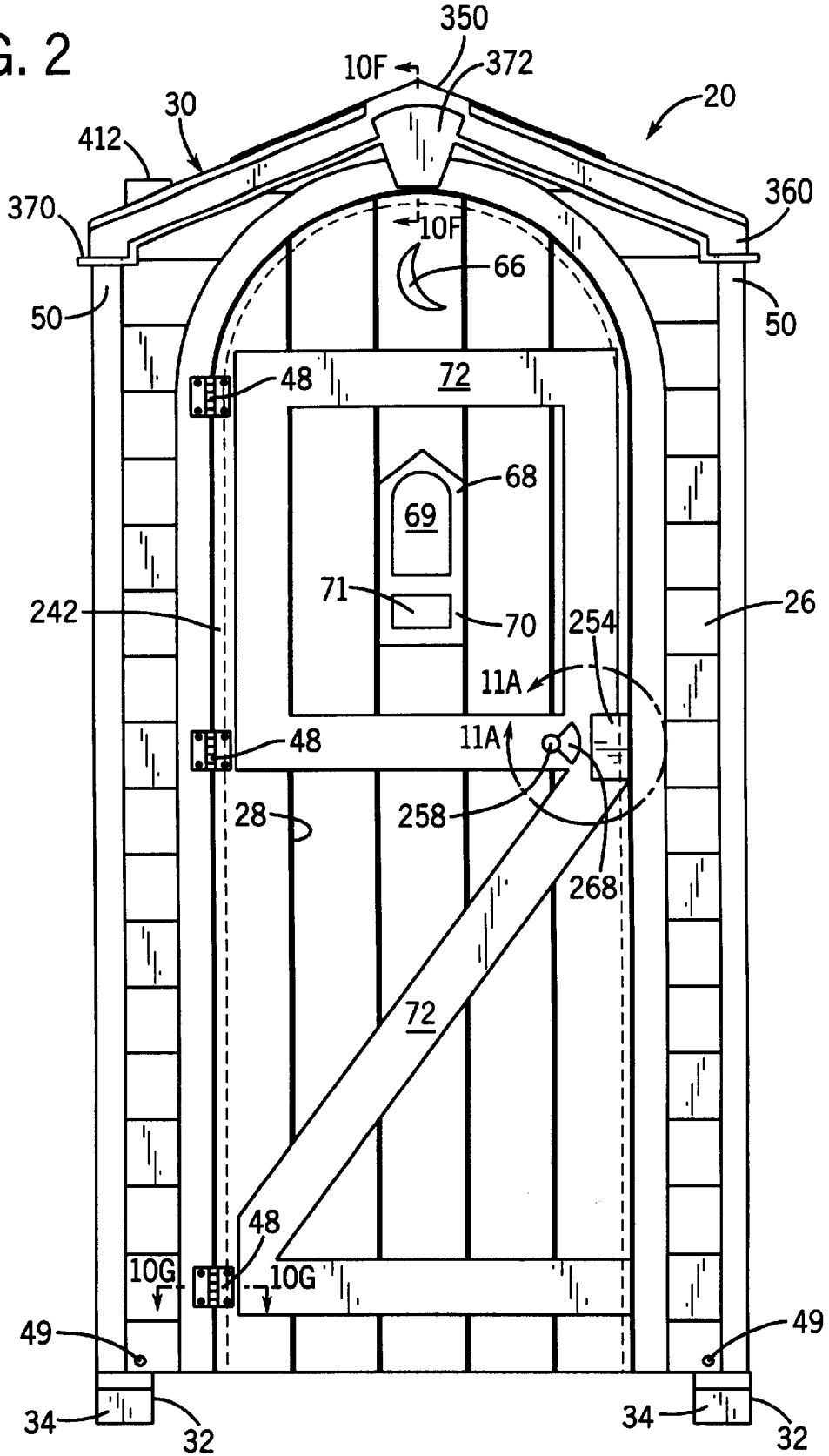
FIG. 2 is a front plan view of the building of FIG. 1.
Figure 3:
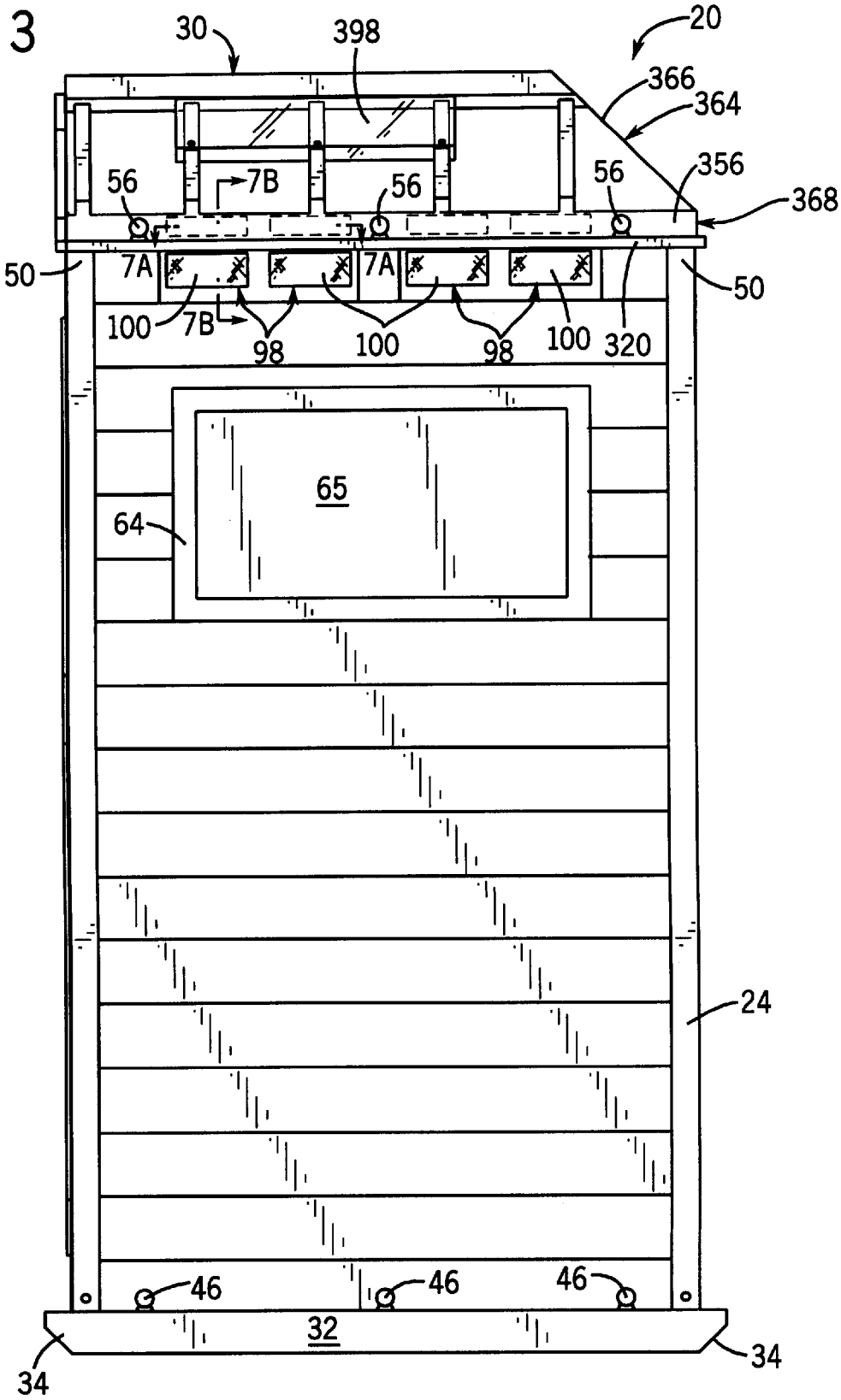
FIG. 3 is a side plan view of the building of FIG. 1.

Having provided the general construction of the outdoor structure 20, the components of the structure 20 will now be described in detail. Referring to FIGS. 1–3, the panels 24 and 26 and door 28 are twin-sheets of plastic resin, preferably a high molecular weight HDPE polyethylene, thermally formed by a blow molding or pressure molding process as is known by those skilled in the art. As can be seen in FIG. 8 for example, the thermally formed sheets are molded such that the two layers join at some points and are spaced apart at various distances elsewhere. The three side panels 24 are formed identically, and therefore, are interchangeable. It should be noted that the invention is not necessarily limited to being practiced by blow molding or twin sheet thermal forming manufacturing processes.

Figure 4A:
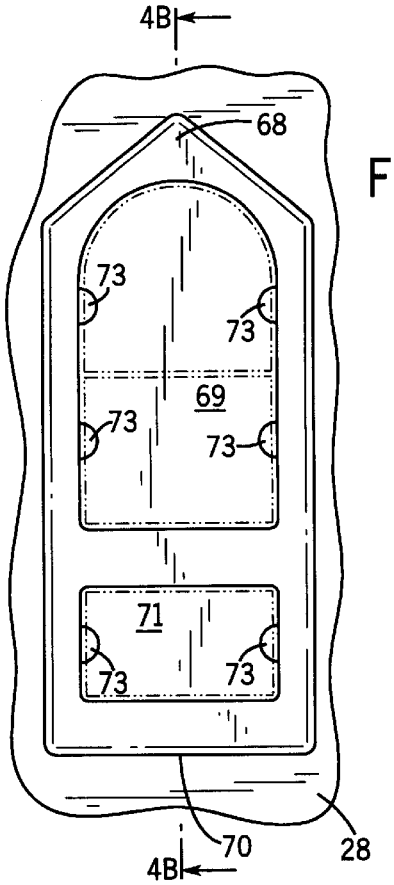
FIG. 4A is a fragmentary front plan view of the gender sign holder and business card holder.
Figure 4B:
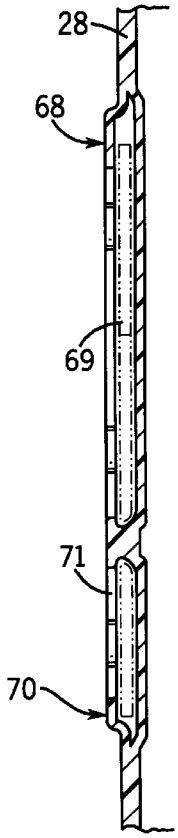
FIG. 4B is a cross sectional view taken along line 4B—4B of FIG. 4A.

The twin-sheet panels 24 and 26 and the door 28 are formed of inner 59 and outer 61 walls to provide interior 60 and exterior 62 surfaces of different configurations, that are welded together where they meet, as is well known. The interior surfaces 60 of the panels 24 and 26 and door 28 have an aesthetically pleasing smooth, seamless surface. Preferably, the exterior of panels 24 and 26 have a surface 62 that resembles the exterior of a house, such as siding (as shown in FIG. 1), clapboards, timbers, bricks or stones, which looks nice and provides reinforcement. FIGS. 1–3 also show that the walls 60 of the panels 24 are molded to resemble various configurations of window frames 64, the pane portion 65 of which may be cut out and replaced with a translucent or transparent plastic sheet if desired or covered with signage. Similarly, the walls 60 can be formed to have an exterior surface 62 defining other features, such as a crescent moon 66 (or any other symbol), gender sign frame 68, business card frame 70 and wooden panels 72. As shown in FIGS. 4A and 4B, frames 68 and 70 define recessed surfaces 69 and 71 for receiving cards indicating the gender designation of the structure 20 and the event sponsor, respectively. The frames 68 and 70 also have slots 73 spaced along the longitudinal sides of the frames 68 and 70 for receiving tabs (not shown) of transparent plastic covers (not shown) sized to fit within the frames 68 and 70.

FIGS. 5A–5E provide an enlarged view of one interconnection between the panels 24 and the framework 38 of the base 22. Referring to FIG. 5A, receivers 46 are recessed into the exterior surface 62 of the panels 24. The receivers 46 have a recessed circular portion 74 with a through bore 76 at its center. An arcuate segment of the circular portion 74 is broken to define a radial opening 78 extending from the center bore 76 through to the bottom edge of the panel 24. Each side panel 24 slides over the bolts 44 in the base frame 38 through the openings 78 in the slots 46. As shown in FIGS. 5B–5C, the center bore 76 is sized to fit over the bolt 44 and the recess 74 is sized to capture a washer 55 on the bolt 44. When the bolt 44 is tightened, this connection prevents the panels 24 from being longitudinally separated from the base 22. To accomplish this, shoulders 75 border the recess 74 adjacent the lower edged washer 55 to prevent the side panel 24 from being pulled off of the base 32 when the bolt 44 is tightened. Ramps 77 lead up to the apex of shoulders 75, to facilitate sliding the receiver 46 under the washer 55. The mouth 79 of the receiver 46, at the lower edge of the panel 24, also flares outwardly to ease assembly.

Referring now to FIGS. 6A–6E, the longitudinal edges 52 of the panels 24 and 26 have a channel 82 formed between a longitudinal wall 84 and a longitudinal tubular member 86, extending in the plane of the panels 24 and 26. The tubular members 86 have barbs 87 which extend partially over the channel 82 and are longitudinally spaced apart approximately twelve inches along a corner edge 89. Longitudinal flanges 88 extend outwardly at approximately 45 degrees from the plane of the panels 24 and 26. Molded within the flanges 88 at the left edges 52 are longitudinal projections 90, having a triangular lateral cross-section, which extend toward the panels 24 and 26. Molded within the flanges 88 at the opposing edges 52 are longitudinal projections 92 having a triangular cross-section sized to nest within the projections 90 and interlock adjacent panels 24 and 26, as shown in FIG. 6E. Such interlocking helps racking of the panels 24 relative to one another. Referring to FIG. 6C, longitudinal corners 50, made of extruded plastic approximately the length of the panels 24 and 26, have a generally C-shaped cross-section that forms a substantially right angle between two long legs 94, each having a short leg 96 at a substantially right angle to it. The short legs 96 have inwardly facing full-length barbs 97 along their free edge 99 which cooperate with the barbs 87 to secure the corner extrusion 50 to the side panel edges. Each panel 24 and 26 is joined to an adjacent panel 24 and 26 by mating the projections 90 and 92 and sliding the short legs 96 of the corner 50 within the channels 82, as shown in FIGS. 6C–6E. The projections 90 and 92 and the corners 50 increase the structural integrity of the structure 20 and prevent the panels 24 and 26 from separating longitudinally, laterally or transversely. As shown in FIGS. 5D and 5E, before the corners 50 are assembled, the panels 24 are secured to the base 22 by bolts 91 inserted in bores 93 in side panels 24 and the transverse members 36 of the base 22. The bolts 91 are secured by nuts 95 in cross-drilled bores 101 in the lateral member 36 of the base framework 38. This arrangement also provides extra support to the base framework 38.

As shown in FIG. 3, vents 98 are disposed in two rows at non-lapped sections near the top edge of the side panels 24. Referring now to FIGS. 6A and 6B, the vents 98 are formed by cutting out rectangular openings 100 through the inner 59 and outer 61 walls of the side panels 24. Rectangular sections of screen 102, made of a wire or plastic mesh material which are larger than the openings, are slid between the vent openings 100 of walls 59 and 61 from the top of the panels 24. The screen sections 102 rest upon a seam 104 below the vents 98 formed by the union of the inner 59 and outer 61 walls.

Figure 8A:
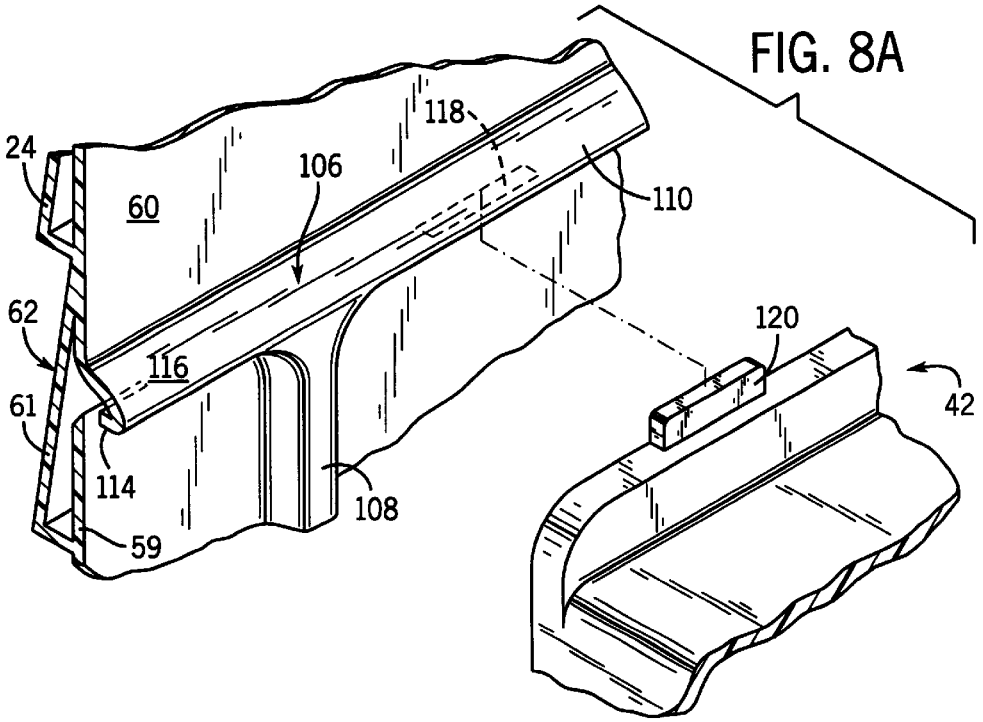
FIG. 8A is a fragmentary exploded perspective view of an interior portion of the side panels and corner of the elimination tank, showing the assembly of a tab on the tank into a cut-out slot in a T-projection of the side panels.
Figure 8B:
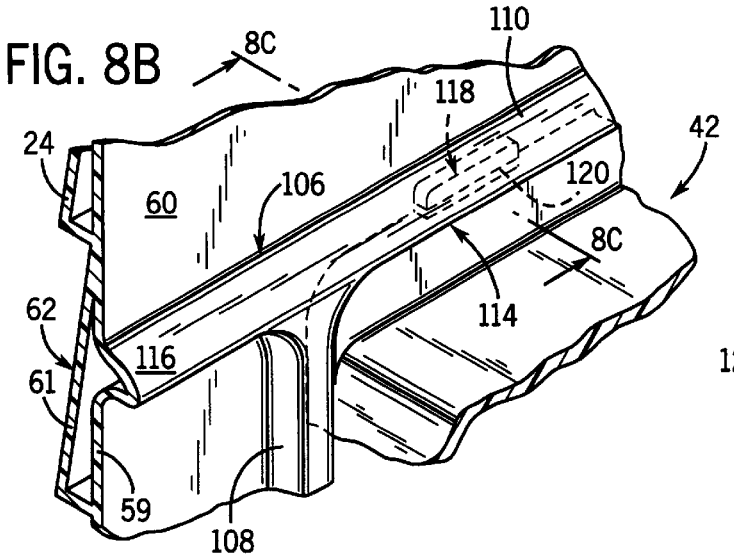
FIG. 8B is a view like FIG. 8A, but showing the assembly.
Figure 8C:
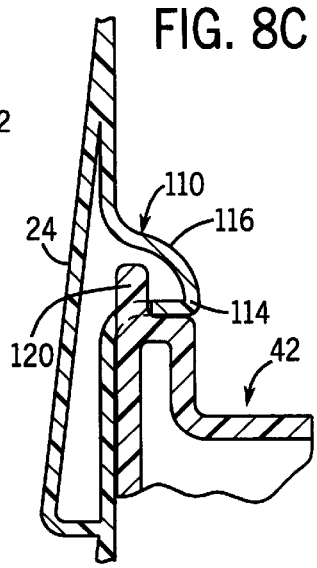
FIG. 8C is a cross-sectional view taken along line 8C—8C of FIG. 8B.
Figure 14B:
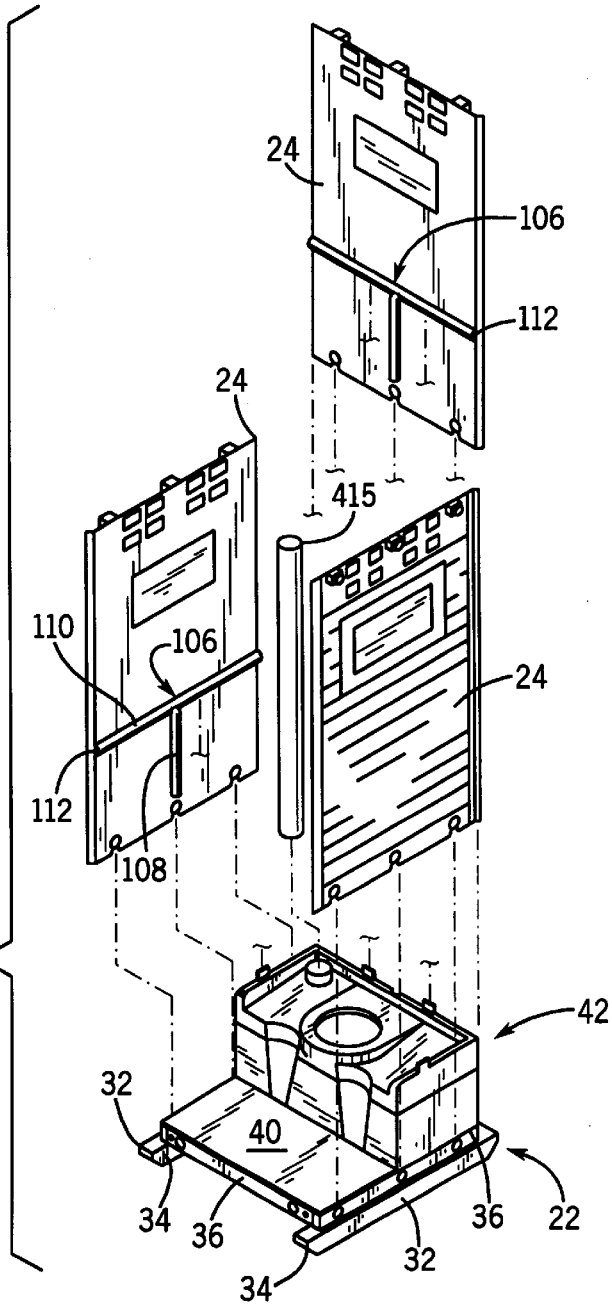
FIG. 14B is an exploded assembly view showing the assembly of the side panels onto the base and tank of FIG. 14A.

As shown in FIGS. 8A, 8B and 14B, the inner walls 59 of the side panels 24 are formed generally flat and smooth so as to be easily washable. However, on the lower portions of each is a T-projection 106 along the central lateral or transverse (depending upon the position of the panels) axis of the panels 24. The T-projections 106 comprise a vertical member 108 having an essentially rectangular U-shaped cross-section and a cross member 110 extending the width of the panels 24 and terminating at tapered ends 112. The cross member 108 defines a wing-like cross-sectional profile formed by a lower flat surface 114 joined at one edge to an upper, arcuate surface 116. Formed into the downwardly facing flat surface 114 are lateral slots 118. Each T-projection 106 has slots 118 that are either cut-out or formed in the lower flat surface 114 at an equal distance from the vertical member 108. The length of the slots 118 is sized to any length necessary to receive lateral tabs 120 of the tank 42. Accordingly, the slots 118 may be sized to receive individual tabs 120 in the tank 42, as shown in FIGS. 8A–8C. Or, the slots 118 may extend the fill length of the T-projection cross member 110 to receive extended length tabs (not shown) or a single, continuous tab (not shown) extending from three sides of the tank 42. Alternatively, the side panels 24 may be formed or cut-out to have lateral (or transverse) slits (not shown) instead of T-projections. The slits are sized to receive a rigid or flexible tank tab (not shown) between the inner 59 and outer 61 walls. As with the slots 118 in the T-projections 106, the length of the slits may be of any length necessary to receive the tank tabs.

Figure 9F:
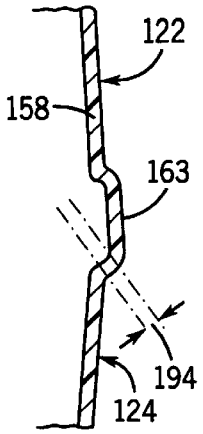
FIG. 9F is a fragmentary cross-sectional view taken along line 9E—9E of FIG. 9A before being separated at the cut-line.
Figure 9H:
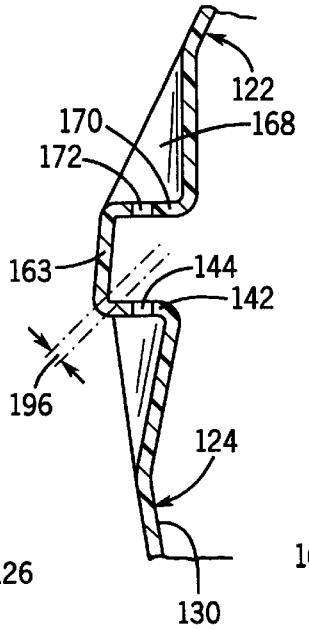
FIG. 9H is a fragmentary cross-sectional view along line 9G—9G of FIG. 9A before being separated at the cut-line.
Figure 9G:
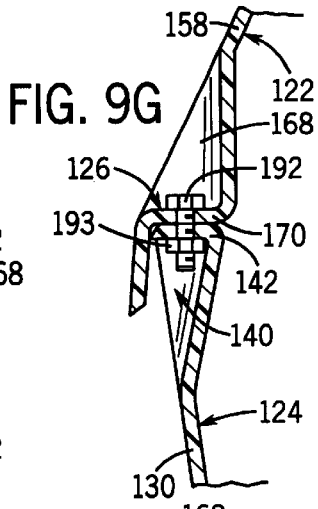
FIG. 9G is a fragmentary cross-sectional view along line 9F–9G of FIG. 9A, showing the connection at the ledge portion of the overlapping seam between the top and bottom sections of the tank of FIG. 9A.
Figure 9E:
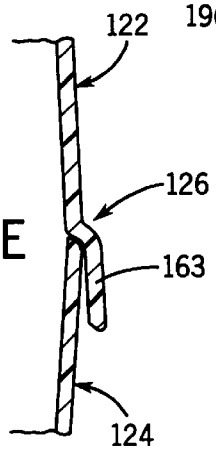
FIG. 9E is a fragmentary cross-sectional view along line 9E—9E of FIG. 9A, showing the overlapping seam between the top and bottom sections of the elimination tank of FIG. 9A and where the seam can be cut to separate the sections.
Figure 9D:
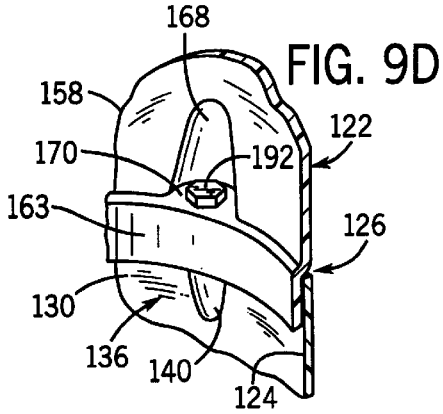
FIG. 9D is a fragmentary perspective view of one connection joining the top and bottom sections of the tank of FIG. 9A.
Figure 9I:
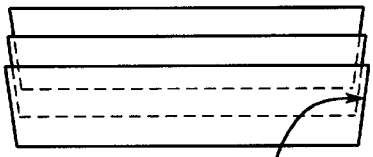
FIG. 9I is a side plan view of nested elimination tank bottoms.

FIGS. 9A–9I illustrate the elimination tank 42. The tank 42 comprises a top 122 and a bottom 124 which mate at a seam 126. The bottom 124 has a substantially rectangular base 128. Trapezoidal front 130, rear 132 and side 134 walls extend upwardly as they taper outwardly from the base 128. The outward taper of the walls 130, 132 and 134 permit multiple bottoms 124 to nest within each other, as shown in FIG. 9J. This nesting reduces the space occupied by the tanks 42, and thereby reduces storage and shipping costs.

Figure 9C:
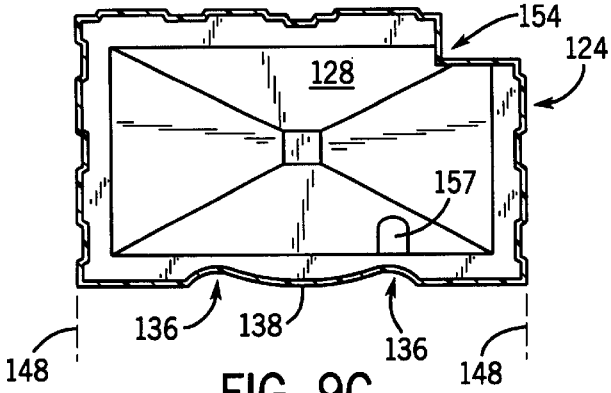
FIG. 9C is a cross-sectional view of the bottom of the tank of FIG. 9A taken along line 9C—9C of FIG. 9B.
Figure 9J:
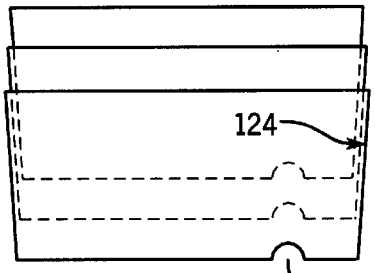
FIG. 9J is a side plan view of nested elimination tank tops.
Figure 9K:
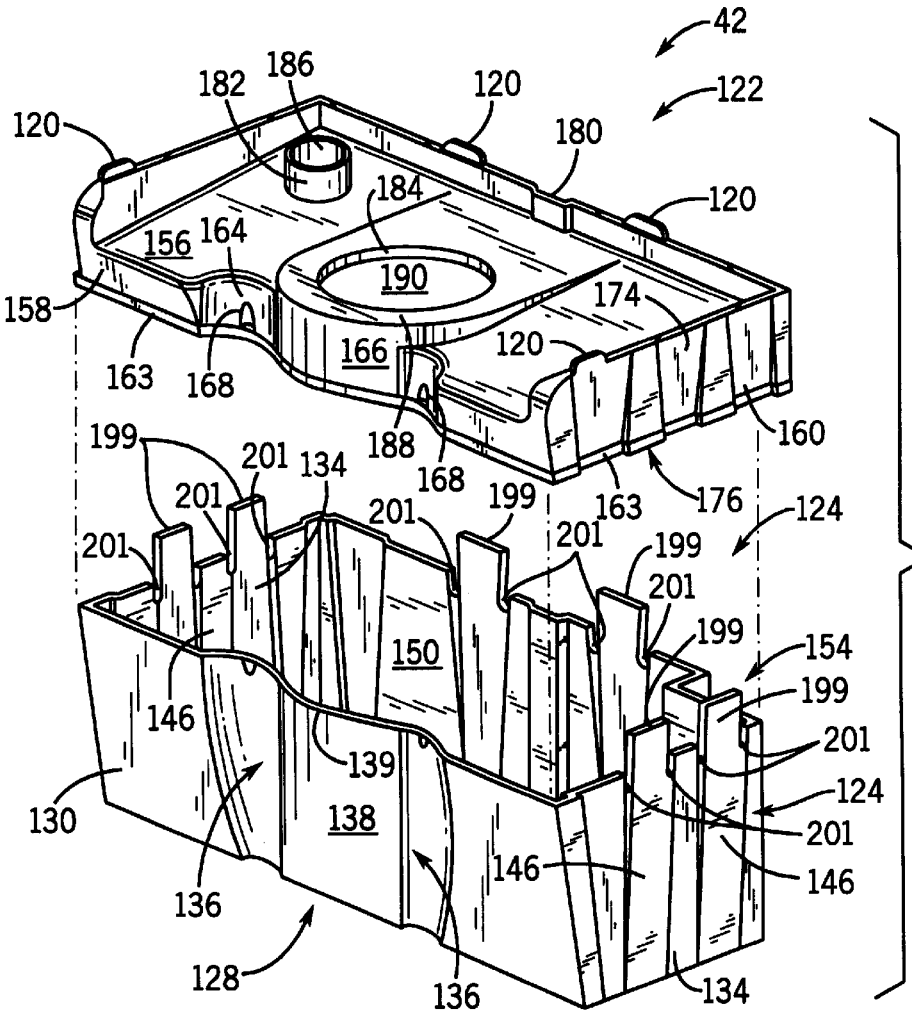
FIG. 9K is an exploded perspective view an alternative embodiment of the tank of FIG. 9A.

The front wall 130 is formed to include two tapered ankle flutes 136 having essentially parabolic, or alternatively rectangular, longitudinal cross-sections spanned by an arcuate surface 138, which can be formed to have a raised splash-guard portion 139 at its center, as shown in FIG. 9K. The ankle flutes 136 can extend to the bottom edge of the tank bottom 124. At the top center of the flutes 136 is a recessed cavity 140 having a lateral ledge 142 spanning its top edge. The ledge 142 contains a bore 144 near its center. The side walls 134 are formed to define trapezoidal, wedge-like slats 146 alternatively projecting on a either side of a mean plane 148, with the center slat 146 on the side of the mean plane 148 closest to the inside of the tank 42. The rear wall 132 is similarly formed, with alternating trapezoidal slats 150 with the center slat recessed on the inside of the tank 42. The wedge-like slats 146 and 150 taper longitudinally toward the base 128. The configuration of the slats provides the tank 42 with sufficient structural integrity to support an above average-sized person.

In the preferred embodiment, the bottom 124 may also be molded to define a notched rear corner 154 having flat or slatted walls 156 that extend upwardly outward from the base 128, as shown in FIGS. 9A–9C. As can best be seen if FIGS. 9D and 9J, a recessed mouse hole or channel 157 extends from the bottom of the ankle flute 136 nearest the notched corner 154 inward toward the rear wall 132. The notched corner 154 provides space for an optional pump and the channel 157 provides space for plumbing (not shown) leading from the pump to a foot pedal (not shown) at the front of the tank 42 for use with a flushable tank.

The top 122 of the tank 42 has a top surface 156 sloping downward from back to front. The top surface 156 is bordered by front 158, side 160 and rear 162 walls downwardly extending outward so as to overlap the top edge of the walls 130, 132 and 134 of the bottom 124 with a flanged lip 163 along the perimeter, as shown in FIG. 9E. As with the bottom 124, the outward taper of the walls 158, 160 and 162 allows multiple tops 122 to be nested within each other, shown in FIG. 9I.

The front wall 158 defines concave 164 and arcuate 166 surfaces to match the flutes 136 and arcuate surface 138 of the bottom 124. The concave surfaces 164 include cavities 168 at their center, spanned by a ledge 170 having a bore 172, similar to those in the bottom 124. The side 160 and rear 162 walls have wedge-like slats 174 formed to opposedly match the top edge of the bottom walls 132 and 134. The wedge-like slats 174 of walls 160 and 162 have an increased thickness at a bottom edge 176.

The side 160 and rear 162 walls extend upwardly beyond the top surface 156. A lateral tab 120 projects upwardly from the top edge 178 of each side wall 160 adjacent the rounded front corners 170. Two lateral tabs 120 project upwardly from the top edge 178 of the rear wall 162, one on each side of the centered, recessed slat 180. The tabs 120 are located to align with the slots 118 within the T-projections 106 of the side panels 24, when the structure 20 is assembled.

Formed to project from the top surface 156 of the tank top 122 to a plane parallel with the base 128 of the tank bottom 124 are a cylindrical aperture 182 and a toilet seat 184. The cylindrical aperture 182 defines an opening 186 for venting the contents of the tank 42. The toilet seat 184 includes a level ring portion 188 defining an oblong opening 190 into the tank 42.

The top 122 and bottom 124 are joined at the overlapping seam 126. Referring to FIGS. 9D and 9G, a bolt 192 is inserted through the bores 172 and 144 in the top 122 and bottom 124, respectively, and fastened into a nut 193 disposed within the cavity 140. The tank 42 may be formed in two pieces by a suitable thermal forming process, or as one piece by, for example, rotational molding. FIGS. 9F and 9H illustrate a one-piece molded tank at the tank seam 126 before the top 122 and the bottom 124 are separated. The top 122 and bottom 124 are separated by cutting at the lines indicated by reference numbers 194 and 196.

Alternatively, the tank bottom 124 may also be formed as shown in FIG. 9K with longitudinal fingers 199 extending upward on various outer slats 146, 150 of the side 134 and rear 132 walls, respectively. In this embodiment, the longitudinal slats in the tank top 122 alternately protrude on the inside and outside of the mean plane opposite to that of the slats in the tank bottom 124. Thus, when the tank 42 is assembled, the fingers 199 fit against the outside of the inner slats in the tank top 122. Longitudinal grooves 201 are formed of cut along the sides of the fingered slats to receive mating portions of outer slats in the tank top 122. The grooves 201 in the rear wall 132 are formed or cut to extend below the grooves in the side walls 134 to allow the contents of the tank to drain from the rear in the event it was over-filled. This prevents the contents from flowing out at the front of the seam and contacting a person using the toilet. All other aspects of the tank 42 being as described above.

Figure 10A:
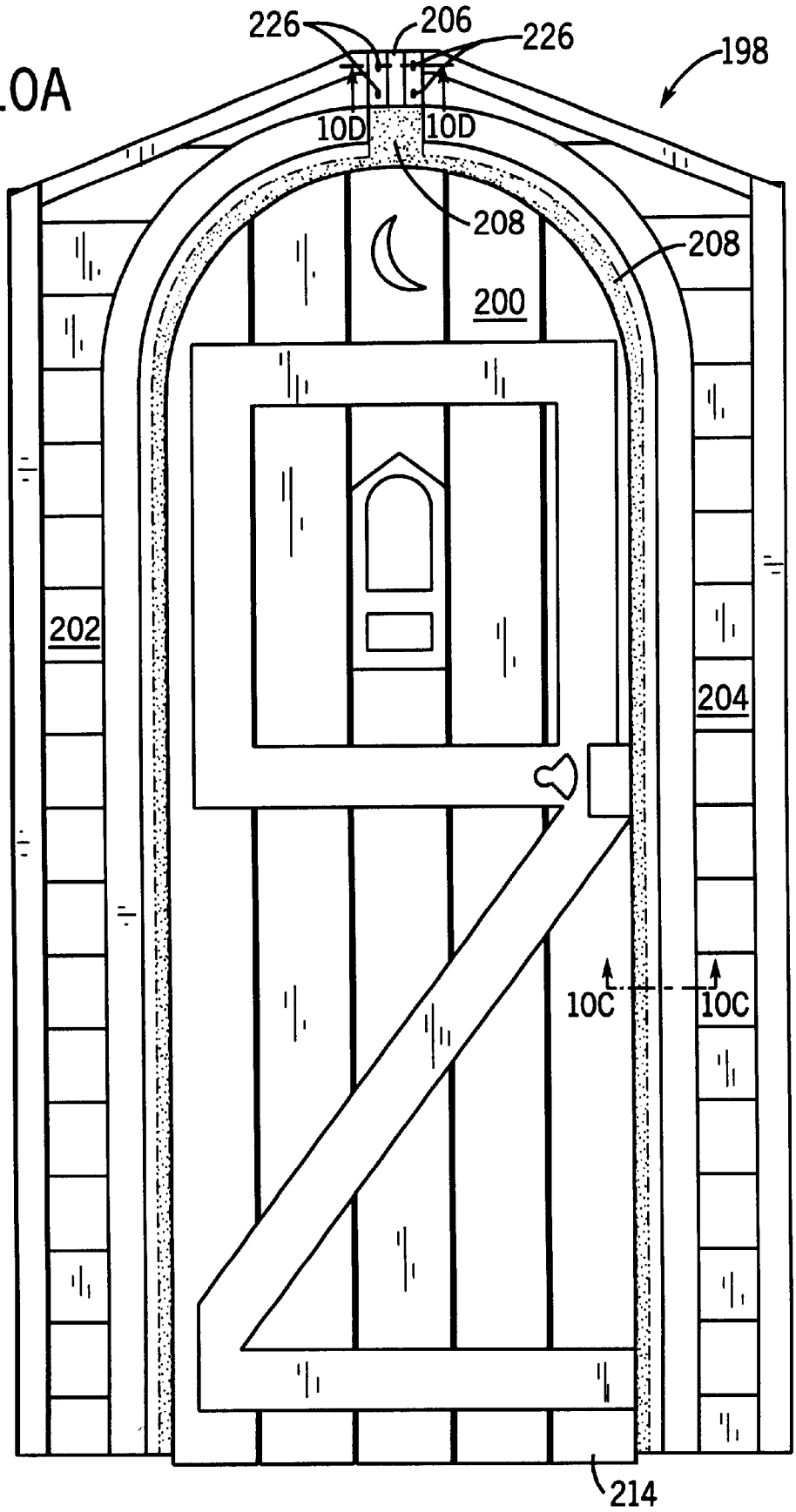
FIG. 10A is a front plan view of a one-piece molded door and door frame panel of the invention before the door is cut out.

FIGS. 10A–10G generally illustrate the formation and connection of the door frame panel 26 and the door 28. The door frame panel 26 and the door 28 are molded in a one-piece panel 198, as shown in FIG. 10A with the molding flash removed, having a door portion 200, first 202 and second 204 door frame portions, a living hinge 206 between the portions 202,204, and waste material 208. The door portion 200 is molded around a vertical support member 210 (shown in phantom in FIG. 11C), preferably made of wood, disposed within a vertical channel 212 (shown in FIG. 12A) formed by the inner 59 and outer 61 walls along the handle side of the door portion 200. A similar vertical wood support may also be provided on the hinge side of the door. The door frame portions 202 and 204 are molded around a support conduit 213 (e.g., steel conduit) disposed within a channel 215 (shown in FIG. 11C) on the handle side. A similar support conduit may also be on the binge side. The one-piece panel 198 has a greater lateral dimension (width) than the finished door frame panel 26 in order to account for the living hinge 206, waste material 208 and overlap of the door and door frame.

The first 202 and second 204 door frame portions are joined to each other at the apex of the panel 198 by the living hinge 206. The waste material 208 (shown shaded in FIGS. 10A and 10C) is the fusion of inner 59 and outer 61 walls in an inverted U-shape of generally uniform width around the door portion 200, which leaves a free-edged bottom portion 214 that extends below, so as not to be flush with, the door frame portions 202 and 204. Additional waste material 208 is disposed between the living hinge 206 and the door portion 200. The waste material 208 is removed by any known means, such as by routing or using any other suitable cutter, and the door portion 200 is separated from the door frame portions 202 and 204.

Referring to FIGS. 10D–10F, the living hinge 206 projects on the inside of the building 20. The living hinge 206 has unfused inner 59 and outer 61 walls over the flexible portion of the hinge. Specifically, the living hinge 206 has a transverse cross-section defining generally parallel longitudinal sides 216 joined by an angled bottom 218 and a top 220 comprising a straight portion 222 and an S-curve portion 224. Two lateral bores 226 are longitudinally spaced through the hinge 206.

Figure 10B:
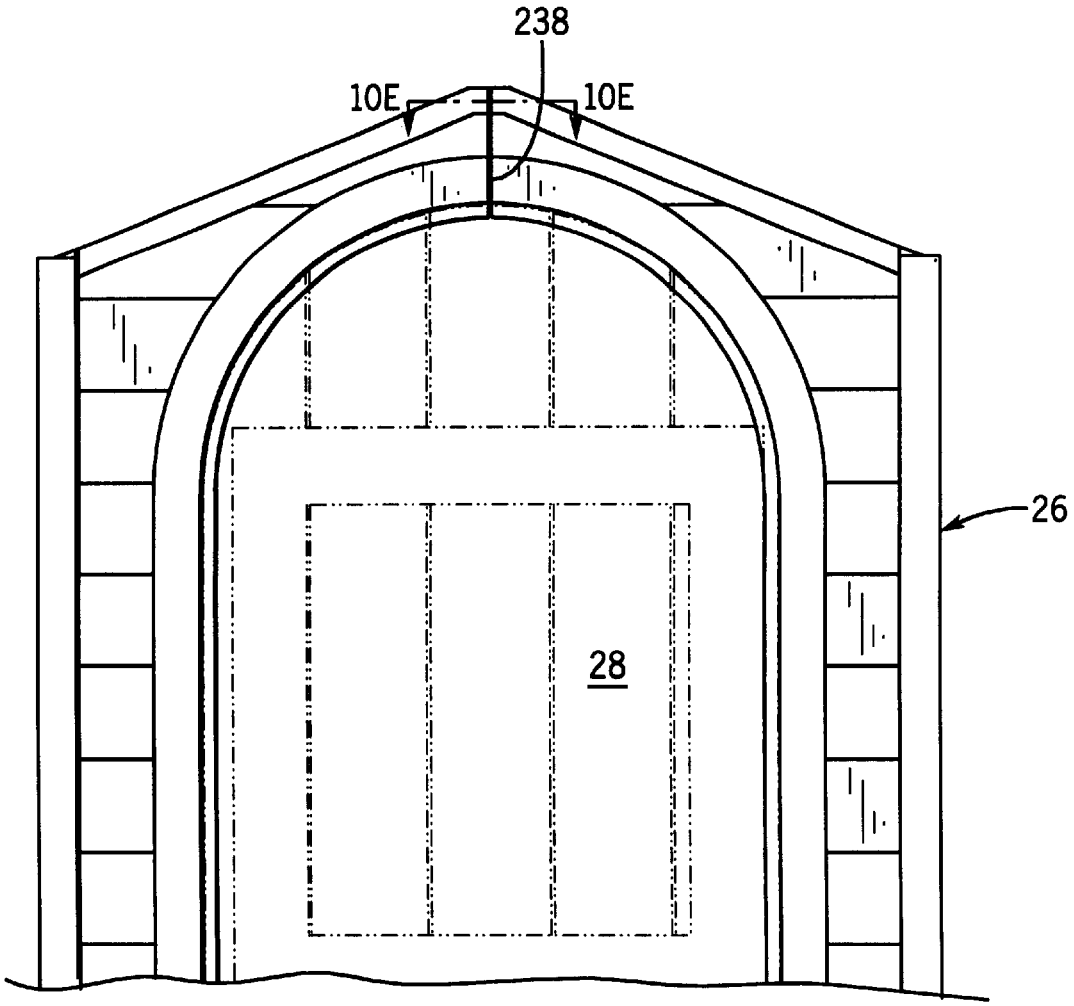
FIG. 10B is a fragmentary front plan view of the front panel after the door is cut out and the remaining door frame is contracted inwardly to overlap the door at the edges.
Figure 10H:
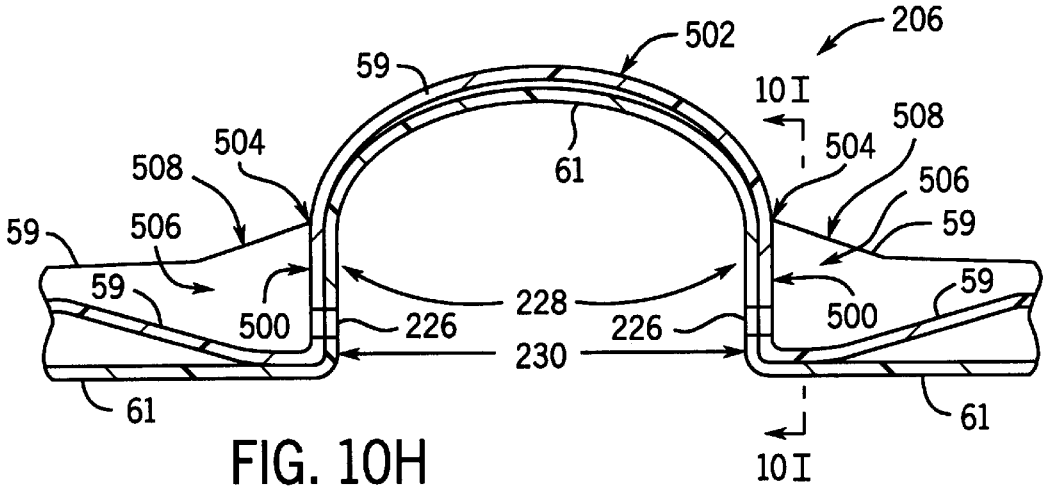
FIG. 10H is a cross-sectional view taken along line 10D—10D of FIG.10A showing an alternate embodiment of the living hinge before assembly.
Figure 10I:
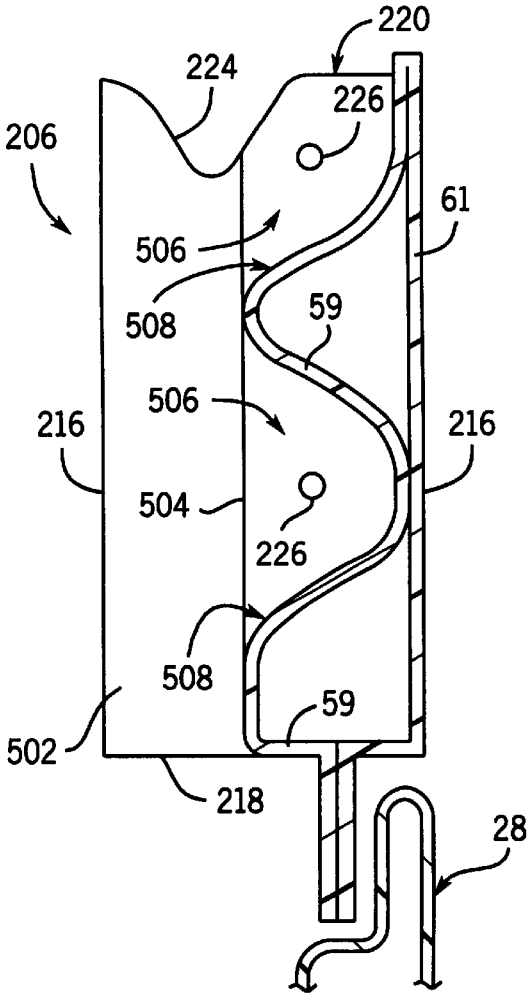
FIG. 10I is a cross-sectional view taken along line 10I—10I of FIG. 10H.

As formed, the living hinge 206 may have a lateral cross-section defining a rounded, inverted V-shape as shown in FIG. 10D. The living hinge 206 may also be molded as shown in FIGS. 10H and 10I. Here, the hinge is formed in an inverted U-shape having two fused, straight sides 500 and a flexing unfused arcuate portion 502 joining the sides 500. The inner wall 59 is formed to extend laterally from the top 504 of the sides 500 and so that it is fused to the outer wall 61 around the bores 226. The inner wall 59 has a convoluted transverse cross-section that defines cavities 506 and support gussets 508 along the straight sides 500. The gussets 508 work to prevent the sides 500 from bending with reduces unwanted flexing of the door panel 26. The cavities 506 provide a place for inserting and tightening fasteners (not shown) in the bores 226 so as join the sides 500 of the living hinge 206 and align the door frame panel 26.

In either case, the living hinge 206 is formed to have an opening 228 at a width 230. The opening 228 is closed to a width 236 by fasteners 232 (shown in FIGS. 10D–10E as a bolts 232 and nuts 234) secured through the bores 226. This forms a butt-joint 238 between the door frame portions 202 and 204 and creates the properly sized door frame panel 26, as shown in FIG. 10B, while maintaining the door frame halves 202,204 in vertical alignment, and helping to maintain them in the same plane, relative to one another. Additionally, the S-curve 224 in the top 220 defines a hook for hanging hats, jackets or other articles of clothing.

Referring again to FIGS. 10E and 10F, the living hinge 206 may be cut longitudinally along line 600 to remove the door hook portion if desired. In this case, the door frame portions 202 and 204 are no longer integrally united, but are joined by bolts 232 and nuts 234. The living hinge may be cut along line 600 either before or after assembly.

Figure 10G:
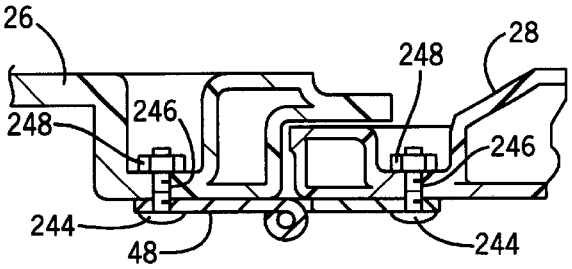
FIG. 10G is a cross-sectional view taken along line 10G—10G of FIG. 2 showing the hinging of the door to the door frame panel.

As shown in FIGS. 2 and 10G, the door 28 is hinged to the door frame panel 26 by three standard hinges 48 spaced longitudinally along the hinge edge 242 of the door frame panel 26. The hinges 48 are secured to the door frame panel 26 and the door 28 by bolts 244 inserted into recessed bores 246 and tightened into nuts 248. Once attached, the door 28 and door frame panel 26 overlap at the top and sides as shown in FIGS. 10F and 10G.

Figure 11A:
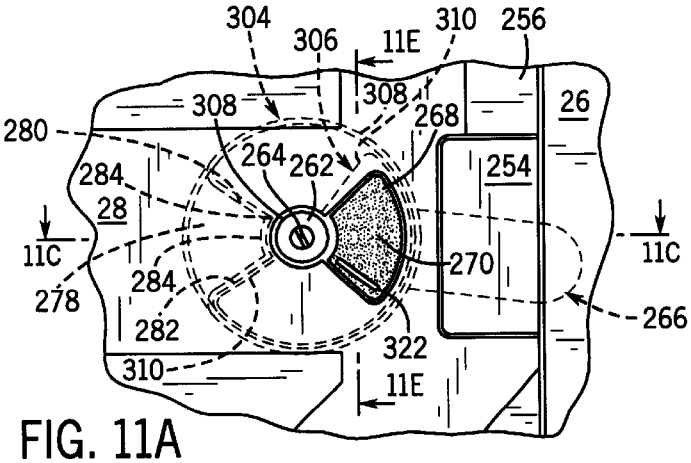
FIG. 11A is a detail view of the area indicated by arc 11A—11A of FIG. 2 of the door and front panel, showing the door latch in phantom in the closed position.
Figure 11B:
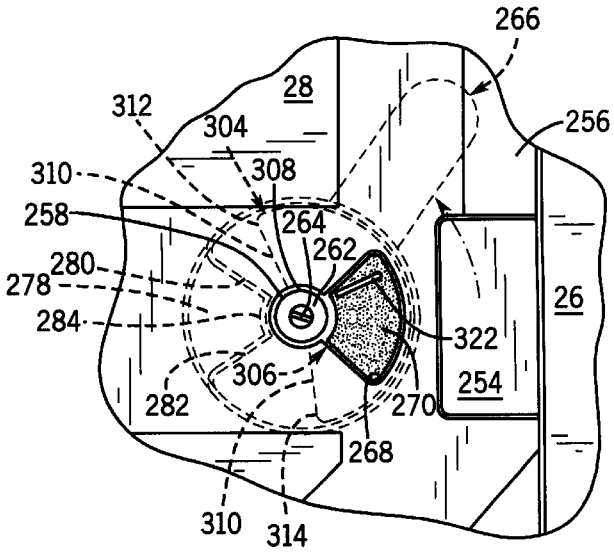
FIG. 11B is a view like FIG. 11A but showing the door latch in phantom in the open position.

As best shown in FIGS. 11A–11B, the door 28 is also formed to include a rectangular handle 254 near the center of the free edge 256 of the door 28. The handle 254 projects outward so as to define a pocket 257 for receiving a person's hand when opening the door 28. Located laterally inward from the handle 254 are formed a circular recess 258 and a center opening 260 which receives a washer 262 and a bolt 264 so as to secure the inside door latch 266 to the door 28. An arcuate occupancy window 268 is formed adjacent to the recess 258 to allow viewing of the red, "in use" or green, "not in use" portions of the indicator decal 270 adhered to the latch 266.

Figure 11C:
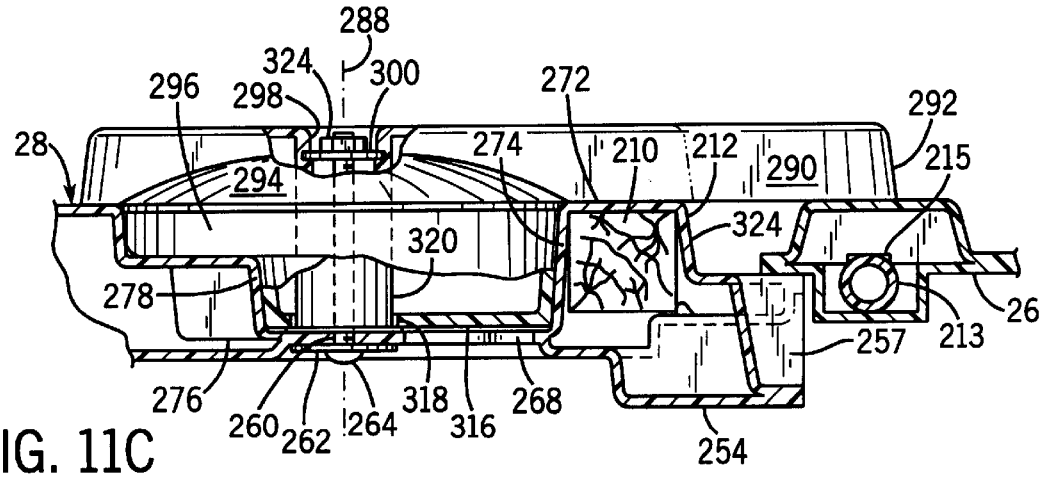
FIG. 11C is a cross-sectional view taken along line 11C—11C of FIG. 11A, showing the door latching mechanism.

As shown in FIG. 11C, the inner wall 59 of the door 28 is formed to include an inwardly projecting raised area 272 adjacent to, and partially defining, the pocket 257 of the door handle 254. The raised area 272 also defines a circular recess 274 that is concentric with the center opening 260. A bottom 276 of the circular recess 274 is fused to the outer wall 61 and is cut out to define the center opening 260 and the arcuate window 268. Also, the bottom 276 defines an arcuate stop 278 projecting into the recess 274. The stop 278 opposes the occupancy window 268 and defines a similar arcuate perimeter having first 280 and second 282 stop surfaces joined by a concave, arcuate surface 284. Additionally, a latch stop 286, comprising a dimple-like impression, is formed within the raised area 272, located longitudinally above the arcuate window 268.

As shown in FIGS. 11C and 11G, the latch 266 pivots along a transverse axis 288 through the center opening 260 in the door 28. The latch 266 is formed to comprise a lever portion 290 having a smooth rounded end 292. The lever portion 290 laps across a circular base portion 294 sized to fit within the circular recess 274 formed in the raised area 272 of the door 28. Sides 296, defining a frusto-conical segment, provide a smooth transition from the lever portion 290 to the circular base portion 294. The lever portion 290 defines a circular recess 298 concentric with the circular base portion 294 for receiving a washer 300 and bolt 264 which secures the latch 266 to the door 28. The circular base portion 294 extends transversely to a first surface 302 having an outer circumference 304 defined by the circular base portion 294 and an inner edge 306 defined by a concentric, convex arcuate portion 308 joining angled straight portions 310. First 312 and second 314 transverse catch surfaces extend toward a second surface 316 having a perimeter defined by the outer circumference 304 of the circular base portion 294 and the inner edge 306 of the first surface 302. A bore 318 is cut through the second surface 316 concentric with the lever recess 298. A cylindrical bushing 320, preferably made of a polyvinyl chloride material, has an outer diameter sized to tightly fit within bore 318 and an inner diameter sized to tightly fit around the lever recess 298 in the lever portion 290.

Referring to FIGS. 11A, 11B, 11E and 11G, a rectangular slot 322 is disposed radially within the second surface 316 at approximately the midpoint of the arcuate segment defining the second surface 316. The slot 322 is sized to receive a small prying object, such as a coin, to open or close the latch 266 from outside the structure 20. The occupancy-indicating decal 270 is affixed to the second surface 316 so that the red, unoccupied portion is located counter-clockwise from the radial slot 322 and the green, unoccupied portion is located clockwise from the radial slot 322.

The base portion 294 of the latch 266 is inserted into the circular recess 274 of the door 28 so that the second surface 316 contacts the recess bottom 276. The bolt 264 is inserted through the washer 300, which fits within the outer circular recess 258 of the door 28. The bolt 264 is then inserted through the opening 260 in the door 28 and the bushing 320 in the latch 266 and tightened to a nut 324 disposed within the lever recess 298.

The latch 266 is formed so that the first catch surface 312 butts against the first stop surface 280 when the latch 266 is in an upright, unlatched position. Conversely, the second catch surface 314 is formed to butt against the second stop surface 282 when the latch 266 is in a horizontal, latched position. The abutting surfaces of the stops 280, 282 and the catches 312, 314 permit the latch 266 to pivot through approximately 90 degrees.

Figure 11D:
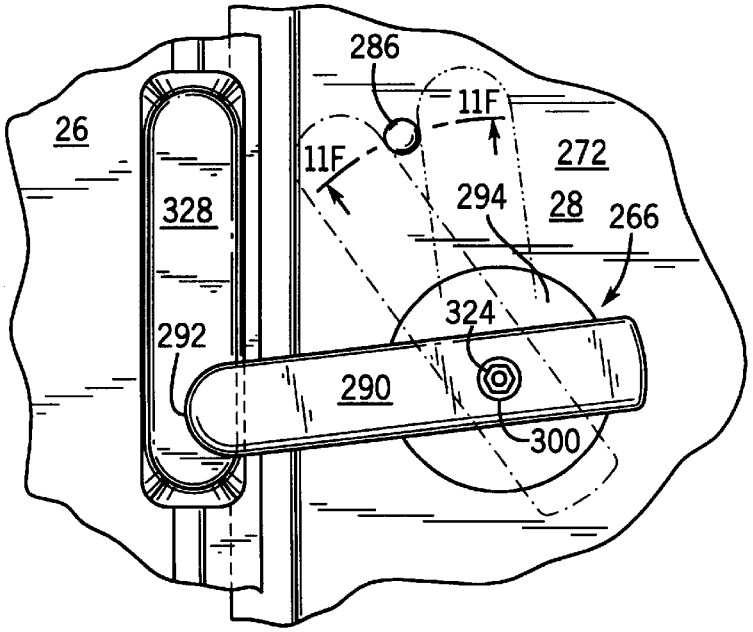
FIG. 11D is a fragmentary rear view of the door and front panel of FIG. 11A, showing the door latch from inside the outdoor structure.
Figure 11E:
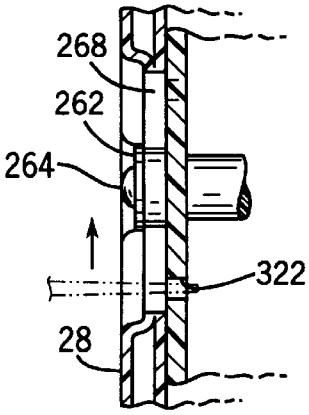
FIG. 11E is a fragmentary cross-sectional view along line 11E—11E of FIG. 11A.
Figure 11F:
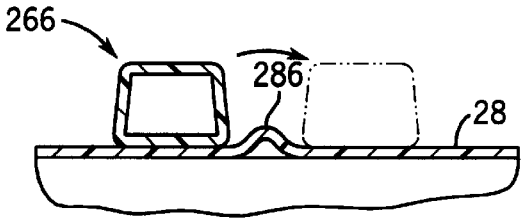
FIG. 11F is a cross-sectional view taken along arc 11F—11F of FIG. 11D, showing the latch on each side of the latch stop dimple.

As shown in FIGS. 11D and 11F, the dimple 286 is positioned between the arc swept by the lever portion 290 of the latch 266. The dimple 286 protrudes only far enough to prevent the latch 266, when in the upright position, from latching unintentionally, as when shipping. Additionally, transverse walls 326 of the raised area 272 provide a structural support for the lever portion 290 so as to prevent intentional damage to the latch 266. Also, a longitudinal strike plate 328 is formed in the inner wall 59 of the door panel 26 adjacent to the exterior door handle 254. The strike plate 328 protrudes transversely to allow the latch 266 to pivot over it and lock the door 28.

Referring to FIG. 11H, an alternate latch 266A includes the circular base portion 294 and a lever portion 290A having a lengthwise recess 291 providing space for a user's fingers. The lever portion 290A of this latch 266A also has a flat end 293.

Figure 12B:
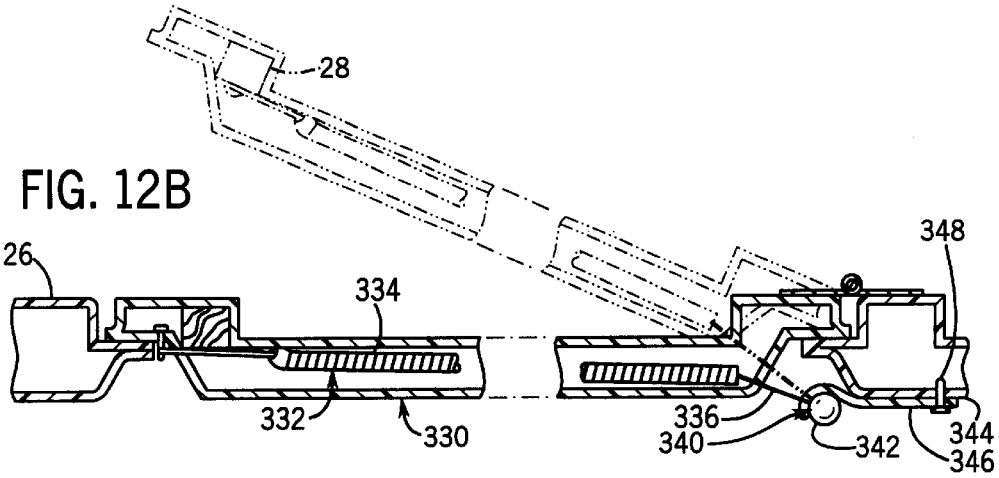
FIG. 12B is a fragmentary top cross-sectional view taken along line 12B—12B of FIG. 12A, showing the door tensioning mechanism.
Figure 12A:
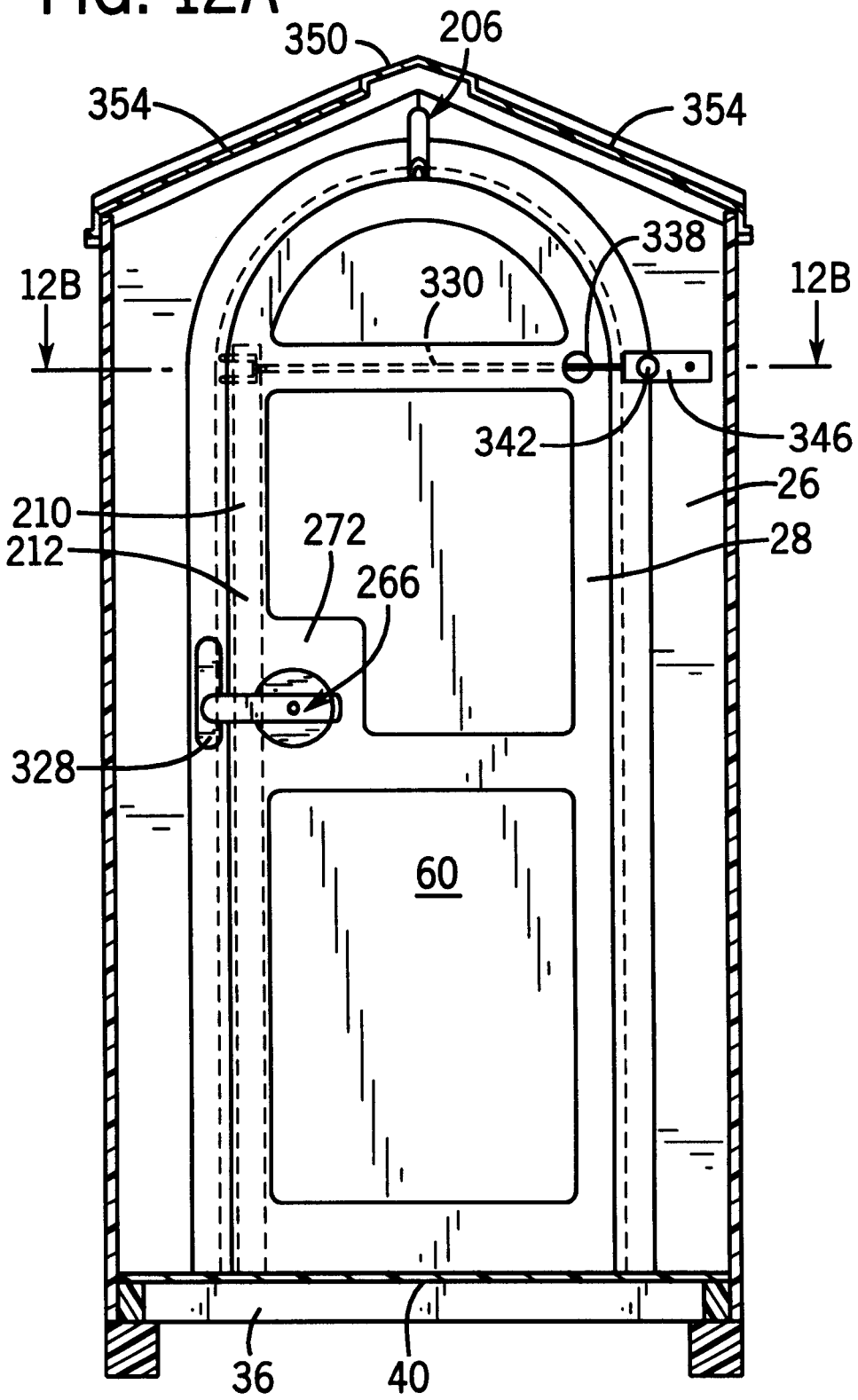
FIG. 12A is a front view of the door and door frame panel from inside the structure.

Referring now to FIGS. 12A–12B, the door 28 is also molded to include at least one lateral raised channel 330 for enclosing the door tensioning mechanism 332. The door tensioning mechanism 332 can be constructed in any manner sufficient to allow the door 28 to open, but be biased in contact with the door frame panel 26. For example, a door spring 334 can be affixed at one end to the door 28 and at the other end to a cable 336 that extends through an opening 338 in the edge of the door 28. The free end 340 of the cable 336 has a ball-like element 342 that can be captured within a socket 344 disposed within a bracket 346 mounted near the inside corner of the door frame panel 26 by fasteners 348. A second similar channel and closing mechanism may be provided near the bottom of the door, and a third could be added in the middle.

Figure 13A:
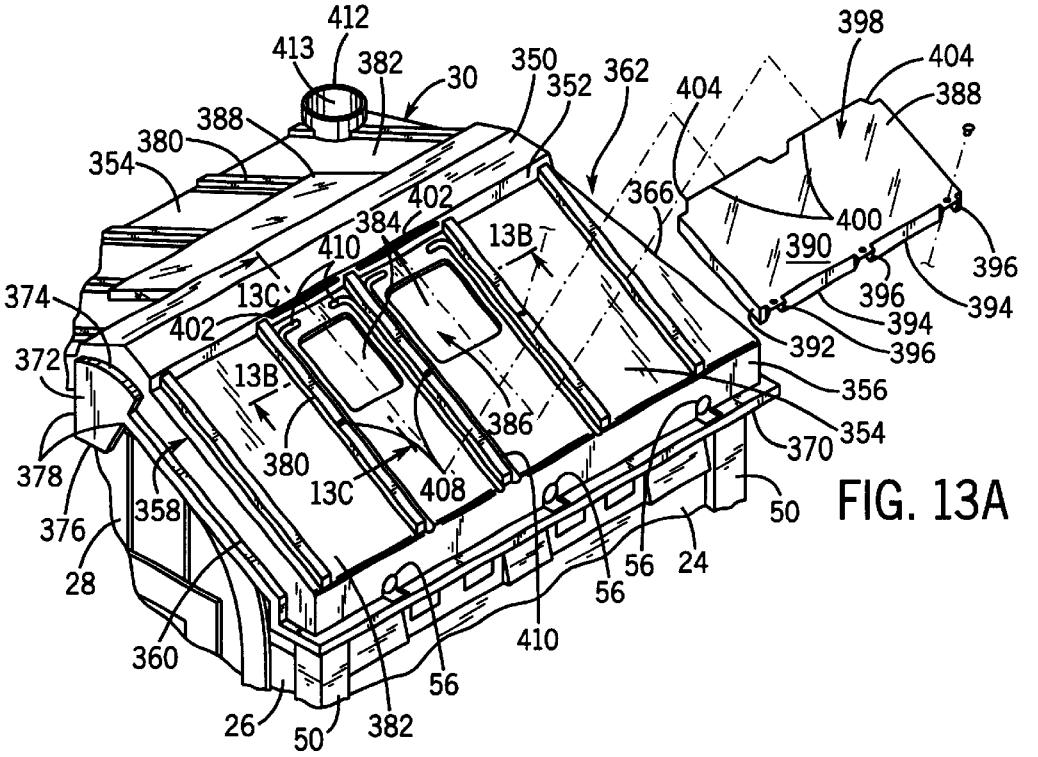
FIG. 13A is a fragmentary perspective assembly view of the roof and skylight cover of the building of FIG. 1.
Figure 13B:
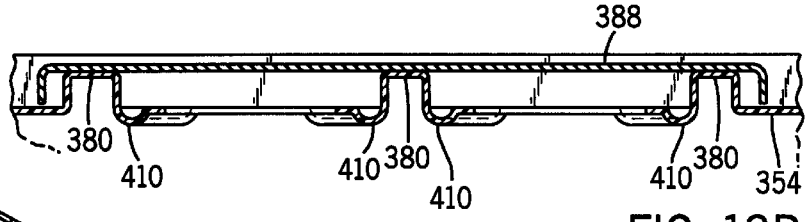
FIG. 13B is a fragmentary side cross-sectional view taken along line 13B—13B of FIG. 13A.
Figure 13C:
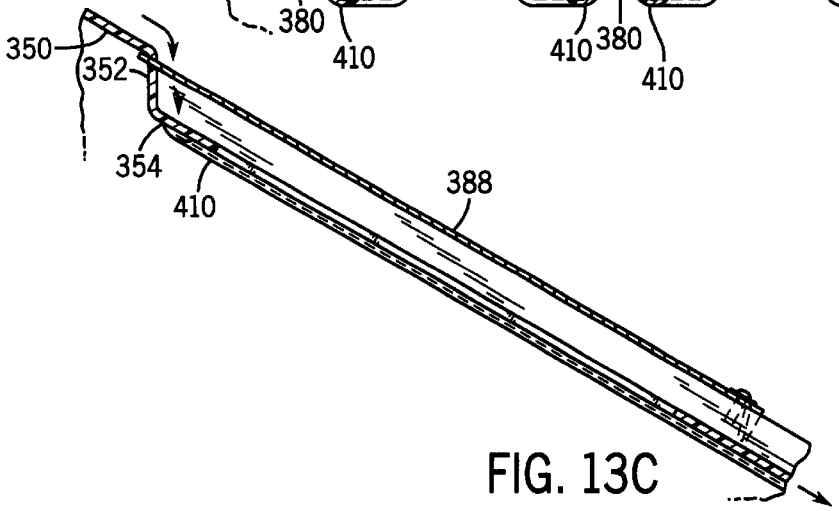
FIG. 13C is a fragmentary cross-sectional view take along line 13C—13C of FIG. 13A.

Referring now to FIGS. 13A–13C, the roof 30 is formed of one sheet of plastic having lateral and transverse dimensions slightly larger than the base 22 so that when assembled, it will overhang the side panels 24. The roof 30 comprises an angled transverse ridge-line peak 350 that terminates at its sides at short longitudinal surfaces 352. Lateral roof surfaces 354 slope downward from the longitudinal surfaces 352 to longitudinal side fascia 356. A front gabled end 358 of the peak 350 and roof surfaces 354 terminate at a front fascia 360. A back edge 362 of the peak 350 and roof surfaces 354 terminate at a transversely sloping roof surface 364 so that the roof surfaces 354 and 364 form two angled ridges 366 and the transversely sloping roof surface 364 terminates at a longitudinal rear fascia 368 that joins the side fascia 356. A bottom edge of the fascia 356, 360 and 368 defines a raised trim 370. The trim 370 leads into a raised keystone feature 372 at the apex of the front fascia 360. The keystone 372 has a rounded top edge 374 joined to a substantially horizontal lower edge 376 by tapered, straight sides 378. The keystone 372 extends downwardly to conceal the living hinge seam 206 in the door frame panel 26, but not interfere with the movement of the door 28, when the roof 30 is assembled to the panels 24. Each side fascia 356 also includes three recessed connector slots 56 as in the side panels 24 to receive bolts 44 and washers 55.

For structural support, the lateral roof surfaces 354 are formed to define five upwardly projecting lateral ribs 380 extending from the peak 350 to the side fascia 356. The first and last ribs 380 are located at each lateral end of the peak 350 and the remaining three ribs 380 are spaced evenly between them so to define four rectangular panels 382. Generally rectangular openings 384 are cut out of the center two rectangular surfaces 382 to define a pair of skylights 386 in each lateral roof surface 354.

Each set of skylights 386 are covered by a translucent cover 388 having a planar surface 390 and lateral 392 and transverse 394 side walls. The transverse side walls 394 include three notches 396 sized to fit over the three central ribs 380 of the roof 30. The covers 388 also has a tabbed edge 398 having two transverse tabs 400 sized to snugly fit within transverse slits 402 cut into the longitudinal surfaces 352 of the peak 350. The tabs 400 have tapered corners 404 to aid in inserting the tabs 400 into the slits 402. The covers 388 are assembled to the roof 36 by inserting the tabs 400 into the slits 402 and fitting the notches 396 over the ribs 380. Fasteners 406 placed through bores 408 in the covers 388 and the ribs 380, respectively, secure the covers 388 in place.

As best shown in FIGS. 13A and 13B, rain gutters 410, having an essentially semi-circular cross-section, are formed in the perimeter of the two central rectangular panels 382 of the roof surfaces 354. The gutters 410 may form a U-shape around three sides of the perimeter of the central panels 382 or may be disjoined under the tab slits 402 to form opposing, inverted L-shaped gutters 410 as illustrated. In either case, the gutters 410 extend from beneath the ends of the slits 402 to the lower end of the roof 354 surfaces, so that rain can flow off the roof in the direction shown by the arrows in FIG. 13C. Gutters 410 catch any droplets that enter beneath the cover 388 at the ends of the tabs 400, so that they do not enter the inside of the building.

Figures 14C, 14D:
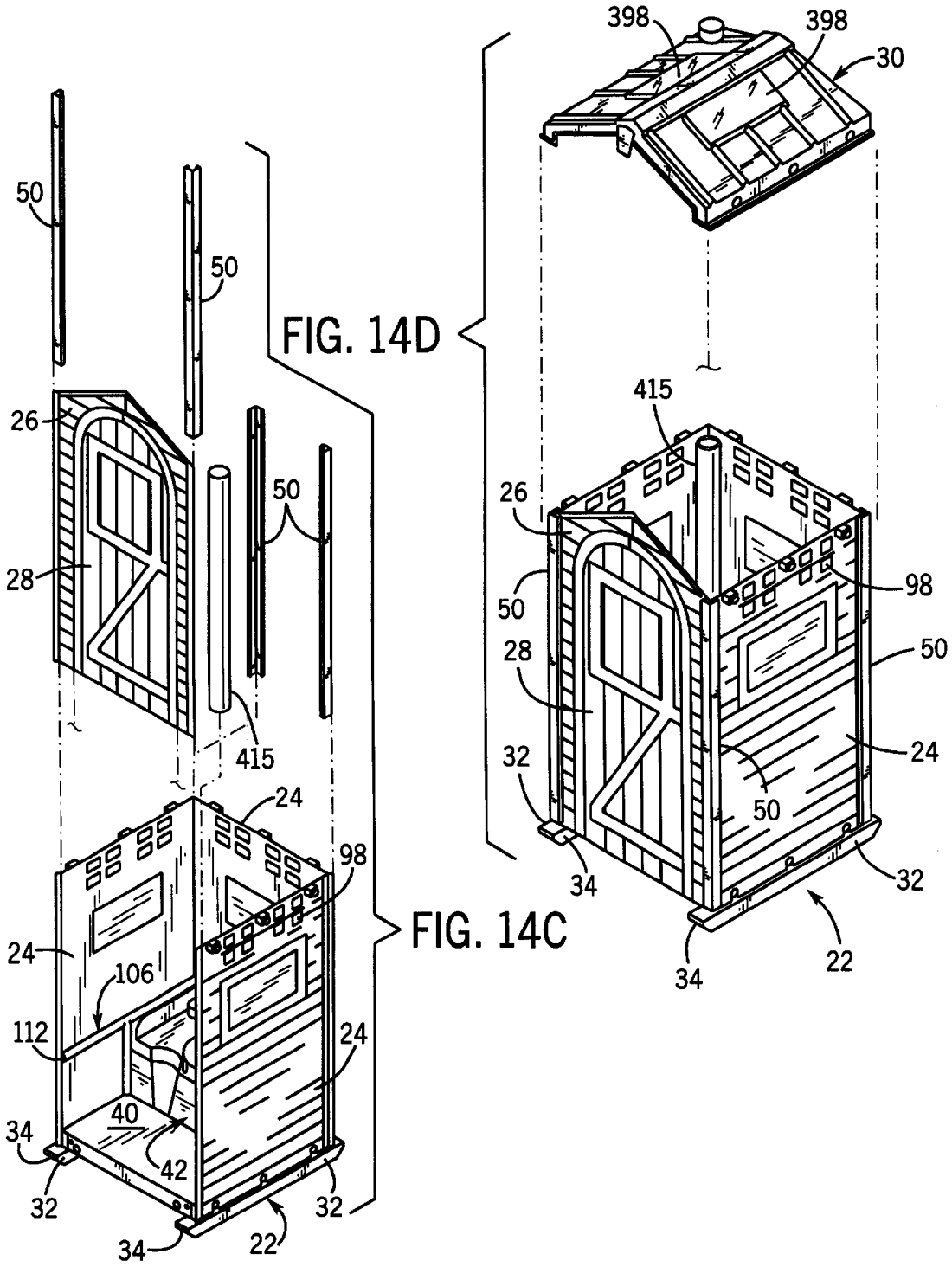
FIG. 14C is an exploded assembly view showing the assembly of the door frame panel and door onto the base and the assembly of the corners onto the side panels of FIG. 14B.
FIG. 14D is an exploded assembly view showing the assembly of the roof onto the door frame and side panels of FIG. 14C.

A cylindrical chimney 412, with opening 413 cut out, is formed to extend longitudinally upward in one roof surface 354 near a corner created by the intersection of lateral 354 and transverse 364 roof surfaces with the side fascia 356. The chimney 412 aligns longitudinally with the cylindrical aperture 182 of the tank 42 when the structure 20 is assembled, so that a venting pipe 415, preferably made of a polyvinyl chloride material (shown in FIGS. 14B–14D), can be connected therebetween.

As shown in FIGS. 7B–7D, the roof 30 is joined to the side panels 24 at three, generally rectangular, stand-offs 381 in the outer wall 61 that project outward at the upper edge of the panels 24. The inner wall 59 is formed to define an inner stand-off recess 383 that meets the outer wall 61 at the face 385 of the stand-offs 381. The stand-offs 381 and the inner stand-off recess 383 have a bore 387 in the face 385 for receiving the bolt 44 which is fastened to nut 58 disposed in the inner stand-off recess 383. This structure is similar to the previously described receivers 46 for attaching the walls to the base.

The preferred method of assembly of the toilet embodiment of the structure 20 is shown in FIGS. 14A–14D. To assemble the structure, the base 22, with the floor board 40 attached, is laid on a flat surface and the bolts 44 in the base 22 are backed out approximately ½". Then, the back wall panel 24 is assembled to the back of the base 22 by placing the receivers 46 over the bolts 44. Then, the tank 42 is placed onto the base framework 38 with the top 122 and bottom 124 of the tank connected together. The tank 42 is tilted backward slightly so that the tabs 120 can be fit within the slots 118 in the T-projection 106 of the rear wall 24, at which point the tank 42 is set in place and the bolts 44 are tightened to hold the rear wall 24 in place. Then, the side walls 24 are assembled by fitting the tank tabs 42 in the T-projection slots 118 and the receivers at the bottom of the panels over the bolts 44, which are then tightened. The flanged edges 88 of the two rear corners of the side panels 24 are joined together by sliding the corners 50 within the edge channels 82. The front panel 26, with the door 28 hinged thereto, is assembled to the base by resting the bottom of the panel on the feet 32 of the base 22 and screwing the threaded fasteners 49 through the bottom of the panel and into the base 22. The flanged edges 88 of the side 24 and door frame 26 panels then are joined together by sliding the corners 50 within the edge channels 82. And, bolts 91 are disposed in the cross-drilled bores 93 and 101 and tightened to nut 95 so as to secure the panels 24 to the base 22. The roof 30 is set on top of the assembled panels 24, 26 and the bolts 44 are inserted through fitting slots 56 fit and the bolts 44 are tightened. Finally, the venting pipe 415 is then inserted into the cylindrical aperture 182 in the tank top 122.

Figure 15A:
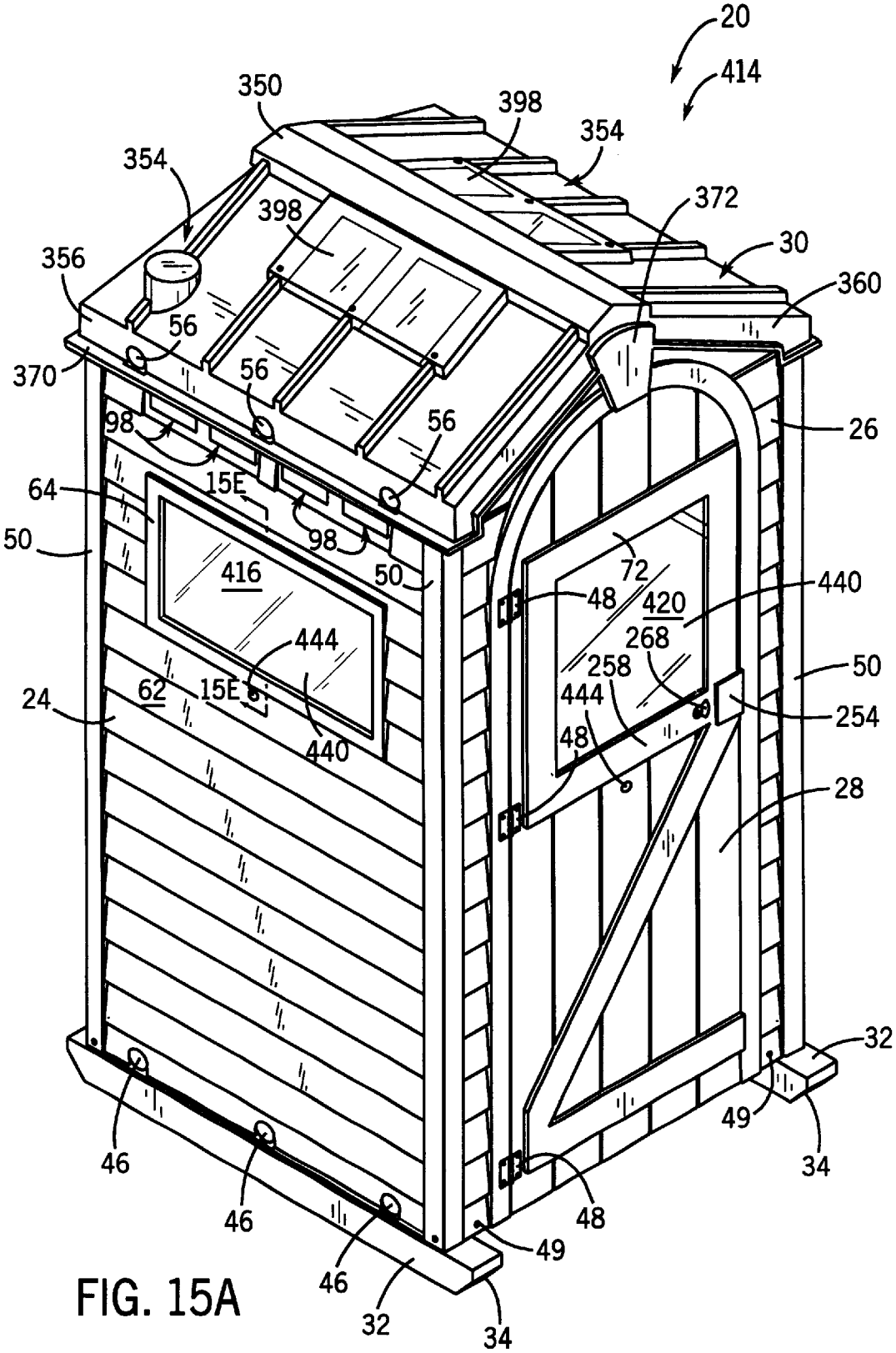
FIG. 15A is a perspective view of a bus stop shelter embodiment of the building of FIG. 1 having side panel and door windows.
Figure 15B:
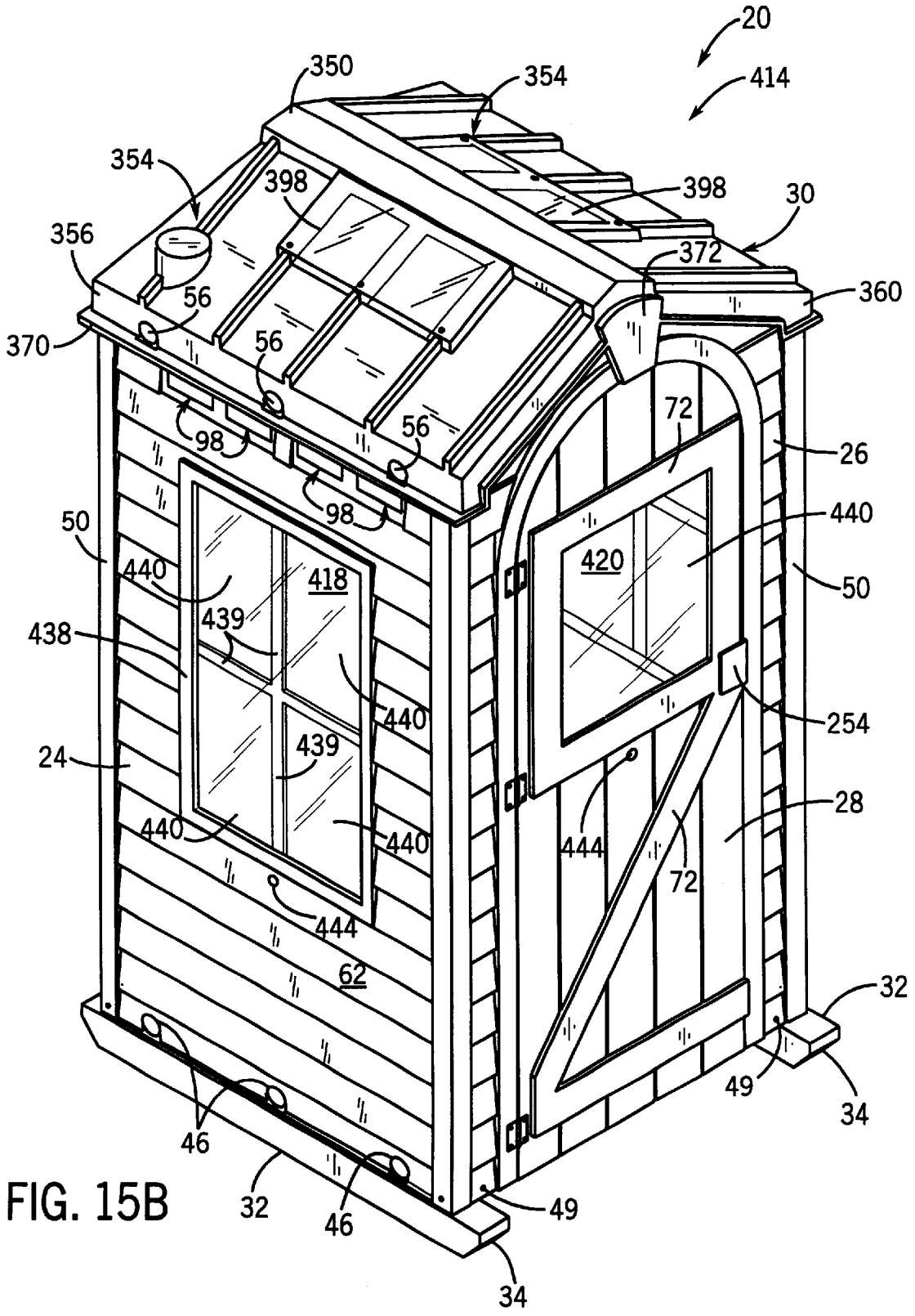
FIG. 15B is a perspective view of a bus stop shelter embodiment having larger side panel windows.
Figure 15C:
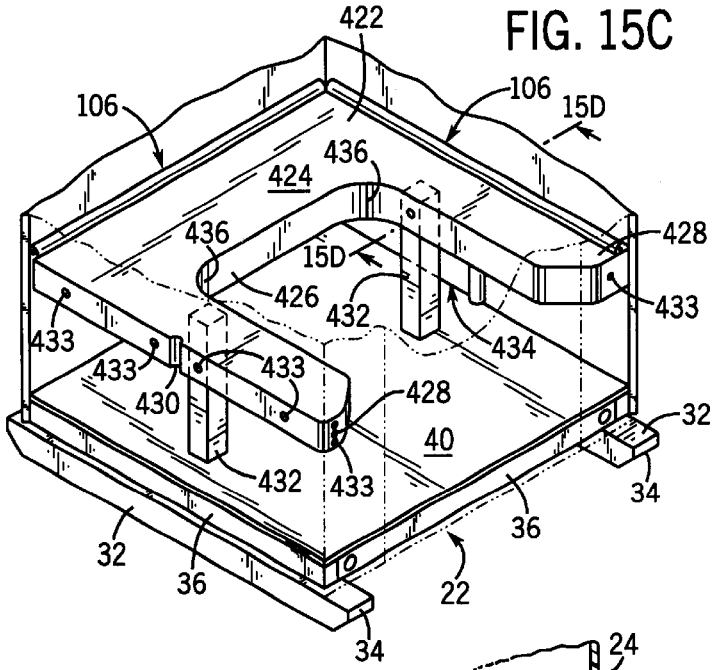
FIG. 15C is a fragmentary perspective view of the bus stop shelter embodiment of FIG. 15A showing a bench inside the shelter.

As shown in FIGS. 15A and 15B, in an alternate embodiment, the building 20 can be used as a bus stop shelter 414. The structure 20, in this embodiment, has a base 22, side panels 24, door frame panel 26, door 28 and roof 30. The side panels 24, having the inner surface T-projections 106, are joined to the base 22 by bolts 44 through slots 46. The panels 24, 26 have edge flanges 52, which are joined by corners 50. The door 28 and door frame 26 are formed in a one-piece panel 198, from which waste material 208 is cut out to define the living hinge 206 and separate the door portion 200 from the door frame portions 202, 204. The door 28 is pivotally hinged to the door frame panel 26 and biased closed by the door tensioning mechanism 332. The door 28 is opened by handle 254 from the outside and locked on the inside by latch 266. In this embodiment, the outdoor structure 20 is constructed and assembled in the same manner as the toilet embodiment described above except: it includes windows 416, 418 and 420 in the sides panels 24 and the door 28; the tank 42 is replaced by a bench 422; the occupancy window 268 is not cut out of the door 28; the opening 413 is not cut out of the chimney 412; and there is no decal 270 on the latch 266.

Generally, the bench 422 is formed in a U-shape to fit against the three side panels 24. The bench 422 has an inverted U-shape cross-section having a seat 424, sides 426 and ends 428, which can be nested within other bench seats. The bench 422 has notches 430 at the outer perimeter to accommodate the stem 108 of the projection 106. Two legs 432, preferably made of a plastic wood material, are fastened to the inside surface 434 of the side walls 426 at the inner corners 436 of the bench 422. The legs 432 are sized so that the seat 424 fits under the cross-bar 110 of the T-projection 106, i.e., approximately the same height as the tank 42. The legs 432 rest on a larger floor board 40 that covers the framework 38 of the base 22. Fasteners 433 secure the bench 422 to the side 24 and door 26 panels at various places.

Figure 15E:
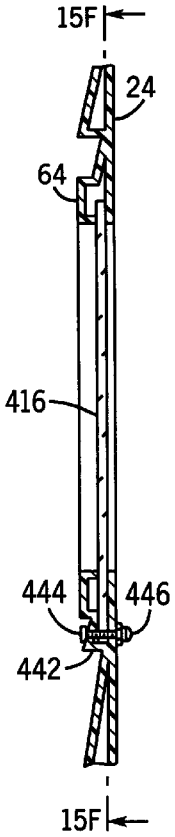
FIG. 15E is a cross-sectional view of the window taken along line 15E—15E of FIG. 15A.
Figure 15D:
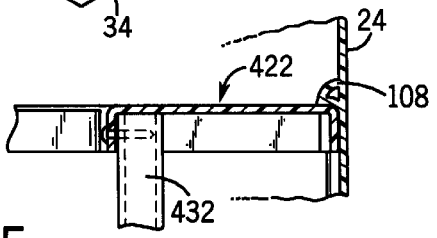
FIG. 15D is a front cross-sectional view of the bench taken along line 15D—15D of FIG. 15C.
Figure 15F:
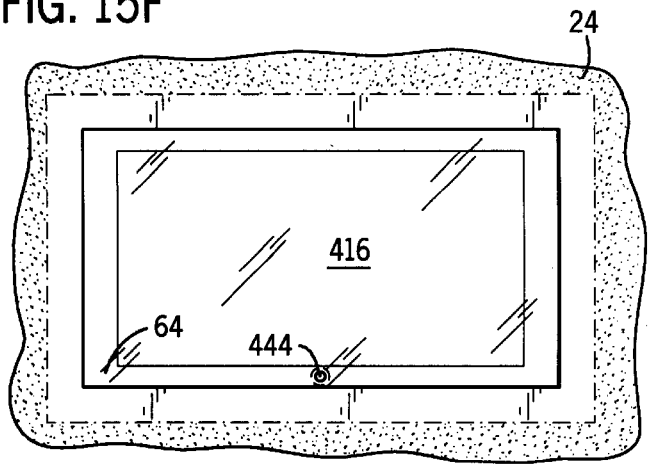
FIG. 15F is a front cut-away view of the window and opening in FIG. 15A taken along line 15F—15F of FIG. 15E.

As stated, the bus stop shelter 414 also includes side panel windows 416 or 418 and door window 420, made of transparent plastic sheets. FIG. 15A illustrates the bus stop shelter 414 with the smaller side windows 416 within frame 64. FIG. 15B shows the larger side windows 418 where the outer walls 61 of the side panels define a large window frame 438 with muntins 439 so as to resemble four-pane windows. The door window 420 is placed where the gender sign 68 and business card 70 frames were located in the toilet embodiment. Openings 440 are cut through the inner 59 and outer 61 walls of the side panels 24 and the door 28. A slit (not shown) is cut into the inner walls 59 below the openings 440 so that the plastic sheet windows may be slid between the walls 59 and 61 and over the openings 440. As shown in FIGS. 15E and 15F, the windows 416 rest on a ledge 442 formed by the union of the inner 59 and outer 61 walls, and although not shown, the large side windows 418 and the door window 420 rest on a similar ledge. The windows 416, 418 and 420 are secured in place by a fastener 444 at the bottom center of the windows which is threaded through the walls 59 and 61 and the windows and into an acorn nut 446.

The present invention may include other aspects not specifically delineated in the aforementioned preferred embodiments. As such, this description in no way is intended to limit the scope of the invention. For example, many of the aforementioned benefits of the present invention apply to buildings with side panels of single-sheet construction. In such construction, since there is only one layer or wall of plastic, the interior and exterior surfaces are the same. Thus, if the exterior of the building was molded to resemble brick or siding, the interior surface would also resemble brick or siding. This is not only aesthetically displeasing, but the recesses and corners forming the desired exterior surface make the interior surface difficult to clean, which is especially undesirable for the outhouse embodiment. Preferably, therefore, the interior surface would be smooth and flat which would resemble an interior wall of a home and be much easier to clean.

Accordingly, buildings made of single-sheet construction may include an insert liner (not shown). The liner is formed of a single sheet of plastic resin of the proper dimension to cover the exposed interior surface of the side panels. The liner can run the full length of the side panels and be trimmed to fit around the tank, or the tank may be removed and reassembled after the liner is inserted. Alternatively, the liner may be sized to cover only the portion of the side panels extending from the top of the tank to the top of the side panels. Either way, the longitudinal edges of the liner are fit into seamed corners of the door panel and side panel connections. The liner may be a non-molded sheet that is rolled up for shipping. The liner sheet may have longitudinal grooves disposed in the sheet at the locations where the rear corners of the building are located to facilitate bending of the liner and to create tight radius corners. The liner may also be thermoformed to define hinged corners corresponding to the rear corners of the building such that the liner may be folded upon itself as three sections. In either case, the liner provides a smooth aesthetically pleasing surface that is easy to assemble and clean.

Figure 16A:
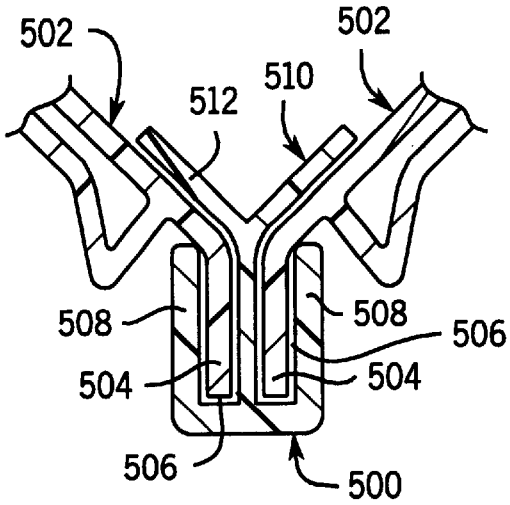
FIG. 16A is a cross-sectional view similar to FIG. 6C of an alternate embodiment of the corner connections.

Furthermore, the side and door panels may also be joined by the alternative corner connectors 500 shown in FIG. 16A. In this embodiment the side panels 502 have side flanges 504 similar to flanges 88 described above and shown in FIG. 6C, however, without the interlocking projections and receivers. Also the longitudinal tubular members 86 defining channels 82 (shown in FIGS. 6B and 6C) may be removed. The corner connectors 500 (one shown) have two grooves 506 for receiving the flanges 504 which define outer walls 508 and a central Y-shaped stem 510. To assemble, the corner connectors 500 are slid over the flanges 504 of two adjacent side or door panels 502 such that the central stem 510 is between the two flanges 504 and the flanges 504 are disposed in the grooves 506. A head 512 of the Y-stem 510 forms a right angle such that outer edges of the head 512 contact the inner surface of the side panels 502 and urge the flanges 504 into the grooves 506 of the corner connectors 500.

Figure 16B:
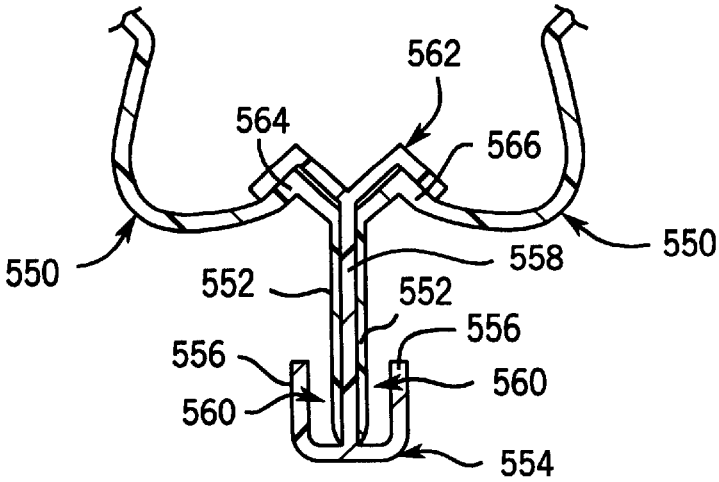
FIG. 16B is a cross-sectional view similar to FIG. 16A of an alternate embodiment of the corner connections.

A variation of the embodiment in FIG. 16A is shown in FIG. 16B. In this embodiment, the side panels 550 have flanges 552. Corner connectors 554 (one shown) have outer walls 556 and an central stem 558 defining two grooves 560 for receiving the flanges 552. The stem 558 has an M-shaped head 562 mating with corresponding angled surfaces 564 and 566 of the side panels 550. In this way, the head 562 of the stem 558 urges the side panel flanges, 552 into the grooves 560 of the corner connectors 554.

Figure 16C:
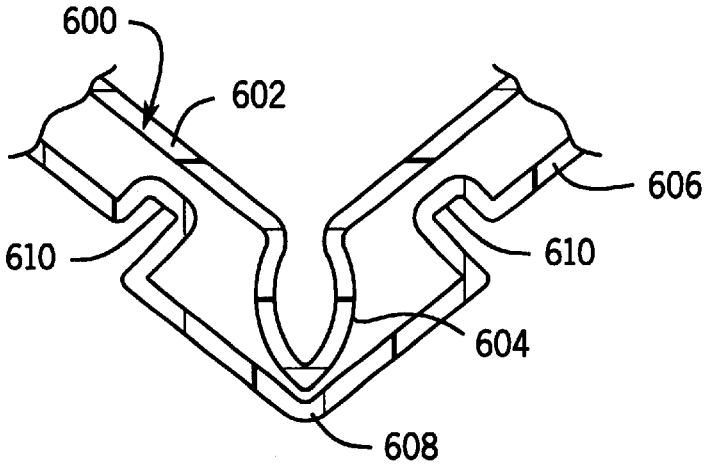
FIG. 16C is a cross-sectional view similar to FIG. 16A of another alternate embodiment of the corner connections.

In still another alternate corner connection embodiment, shown in FIG. 16C, side panels may be molded joined together as a single large panel 600 with an inner wall 602 formed to include two longitudinal living hinges 604 (one shown) at the location of the rear corners of the building. The outer wall 606 forms an aesthetically pleasing corner which conceals the inner wall living hinges 604. Prior to assembly, 10 the internal side walls lie in the same plane and the living hinges 604 are in an open position. For assembly, the single large panel 600 is folded or flexed inward at the living hinges 604 to form three sides at right angles. As shown in FIG. 16C, when assembled, the living hinges 604 are in a closed position and the corner 608 of the outer wall generally forms a right angle. Longitudinal channels 610 are disposed in the outer wall 606 for structural support.

Accordingly, in order to apprise the public of the full scope of the present invention, reference must be made to the following claims.

I claim:

1. A plastic resin building having a base, panels, and a roof, said panels being connected at a bottom end to said base, at a top end to said roof and to each other at first and second longitudinal edges, wherein:

said base includes lateral fasteners having a body and a head of increased diameter than said body, said fasteners spaced apart and extending outward from said base; and said panels having a first wall and a second wall, said first wall defining downwardly opening fittings spaced along the bottom end so that said panels can be mounted to said base by sliding said fittings onto said fasteners and tightening said fasteners, wherein said fittings include raised surfaces that can engage said fasteners when tightened to prevent vertical dislocation of said panels from said base.

2. The resin building of claim 1, wherein said panels have a first flange at said first edge defining longitudinally spaced projections and a second flange at said second edge defining longitudinally spaced depressions, said depressions being located and sized to receive said projections of an adjacent said panel so as to prevent separation of said panels.

3. The resin building of claim 1, further comprising corner connectors extending substantially the height of said side panels and having longitudinal lipped sides sized to fit within longitudinal channels in said first and second edges so as to join adjacent said panels.

4. The resin building of claim 3, wherein said lipped sides of said corner connectors have a beaded edge and said channels include barbs longitudinally spaced and protruding into openings of said channels so as to retain said lipped sides within said channels.

5. The resin building of claim 1, further comprising a bench having a planar seat and depending side walls, said bench being supported by said panels and at least two legs connected to said side walls.

6. A plastic resin building having a base, side panels, a door panel, and a roof, the side panels being connected at a bottom end to said base, at a top end to said roof and to each other and said door panel at longitudinal edges, wherein said door panel defines a living hinge formed as a unitary part of said door panel and joining a first door jamb half and a second door jamb half, said living hinge being flexible so that said first and second door jamb halves can move from an initial molded position to a frame position.

7. The plastic resin building of claim 6, wherein a portion of the living hinge is removed so that the first and second door jamb halves are separate.

8. The resin building of claim 6, wherein said living hinge has an inner ply and an outer ply defining a flexible portion joining parallel first and second walls, said inner and outer plies being separate at said portion, said inner ply defining at least one gusset along outer sides of said first and second walls.

9. The resin building of claim 8, wherein at least one of said flexible portion and said first and second walls have a concave top edge suitable for hanging clothing.

10. A plastic resin building having a base, side panels, a door panel, and a roof, the side panels being connected at a bottom end to said base, at a top end to said roof and to each other and said front panel at longitudinal edges, further comprising:

a door having a free edge and an opposing hinged edge at which said door is pivotally attached to said door panel, said door having a first wall and a second wall, said first wall defining a recess adjacent to said free edge and concentric with a pivot axis, said recess defining projecting open and closed stop surfaces; and a latch centered about said pivot axis and having a unitary base sized to fit within said recess, said base having projecting open and closed catches respectively matable with said open and closed stop surfaces, said open and closed catches radially spaced apart so as to limit the pivot of said latch to approximately 90 degrees;

said latch having a handle with a latching end extending beyond said free edge when said latch is closed.

11. The resin building of claim 10, wherein said first and second walls include openings at a bottom of said recess in said door for viewing said base of said latch from outside said building, said base having an occupancy indicating surface having a first marker representing said latch being fully closed and a second marker representing said latch being fully open.

12. The resin building of claim 11, wherein said base includes a slot radially located between said first and said second marker and sized to receive a prying device inserted through said openings in said first and second walls for rotating said latch about said pivot axis between an open and closed position.

13. The resin building of claim 10, wherein said first wall defines a projection located and extending away from said second wall so as to contact said handle as it pivots between a fully open and a fully closed position, said projection sized to prevent inadvertent closing of said latch from said fully opened position.

14. A plastic resin building having a base, side panels, a door hinged to a front panel, and a roof, the side panels being connected at a bottom end to said base, at a top end to said roof and to each other and said front panel at longitudinal edges, wherein at least one of said door, said front panel and said side panels has first and second walls wherein said first wall defines a frame having a recess sized to receive a sign, said recess having longitudinal walls containing slats spaced apart and sized to receive tabs of a transparent cover sized to fit within said recess.

15. The resin building of claim 14, wherein said recess is generally rectangular and sized to receive a business card.

16. The resin building of claim 14, wherein said recess is generally rectangular with an arcuate top.

17. A plastic resin building having a base, side panels, and a roof, said side panels being connected at a bottom end to said base, at a top end to said roof and to each other at first and second longitudinal edges, said resin building further comprising a corner connector extending longitudinally approximately the length of said side panels, wherein said first and second longitudinal edges terminate at respective first and second flanges angling from said side panels such that adjacent side panels form substantially a right angle when said first longitudinal edge of one of said adjacent side panels is joined to said second longitudinal edge of the other of said adjacent side panels by said corner connector.

18. The resin building of claim 17, wherein said side panels have a first wall and a second wall joined together at said first and second flanges and wherein said corner connectors have two sides forming essentially a right angle therebetween and having inwardly projecting lips at free longitudinal edges, said lips having a beaded edge and being sized to fit within longitudinal channels defined by said first wall in said first and second edges of said adjacent side panels, said channels having a plurality of interruptions extending into openings of said channels such that engagement of said beaded edges and said interruptions prevents said lips from passing through said openings of said channels, thereby holding said adjacent side panels together.

19. The resin building of claim 18, wherein said first flange includes at least one receptor and said second flange includes corresponding at least one projection, said at least one projection of one of said side panels being sized and located to nest within said at least one receptor of an adjacent side panel.

20. The resin building of claim 17, wherein said corner connectors have two sides and a center member joined together at one end and spaced apart to define two channels for receiving said first flange of one of said adjacent side panels and said second flange of the other of said adjacent side panels, said center member having a retaining surface for contacting an inside surface of said adjacent side panels so as to retain said flanges within said channels of said corner connectors.

21. The resin building of claim 17, wherein said side panels have a first wall and a second wall, wherein said first wall defines said first and second flanges such that said first flange of one of said adjacent side panels and said second flange of the other of said adjacent side panels are integrally joined to define a living hinge between said adjacent side panels.

* * * * *